US006257614B1

(12) United States Patent
Duggan

(10) Patent No.: US 6,257,614 B1
(45) Date of Patent: Jul. 10, 2001

(54) DYNAMIC SYNCRONOUS PIVOTING BOOT AND FOOT MOUNTING SYSTEM FOR SPORTINGBOARDS

(76) Inventor: John C. Duggan, 5995 Dover Rd., Lakeview, NY (US) 14085

( * ) Notice: Subject to any disclaimer, the term of this patent is extended or adjusted under 35 U.S.C. 154(b) by 0 days.

(21) Appl. No.: 09/460,466

(22) Filed: Dec. 14, 1999

(51) Int. Cl.[7] ..... A63C 9/02

(52) U.S. Cl. ..... 280/618; 280/14.24; 280/87.042; 441/74

(58) Field of Search ..... 441/74; 280/616, 280/617, 618, 14.21, 14.22, 14.23, 14.24, 87.041, 87.042, 607

(56) References Cited

U.S. PATENT DOCUMENTS

| | | | | |
|---|---|---|---|---|
| 3,771,811 | * | 11/1973 | Bueno | 280/87.042 |
| 4,160,554 | * | 7/1979 | Cooney | 280/87.042 |
| 4,202,559 | * | 5/1980 | Plazza, Jr. | 280/87.042 |
| 4,871,337 | | 10/1989 | Harris | 441/74 |
| 4,955,626 | * | 9/1990 | Smith et al. | 280/87.042 |
| 4,964,649 | | 10/1990 | Chamberlin | 280/618 |
| 5,021,017 | * | 6/1991 | Ott | 441/74 |
| 5,026,080 | * | 6/1991 | Steffl et al. | 280/87.042 |
| 5,085,455 | | 2/1992 | Bogner et al. | 280/618 |
| 5,094,470 | * | 3/1992 | Riedel | 280/618 |
| 5,277,635 | | 1/1994 | Gillis | 441/74 |
| 5,299,823 | | 4/1994 | Glaser | 280/625 |
| 5,354,088 | | 10/1994 | Vetter et al. | 280/618 |
| 5,356,170 | | 10/1994 | Carpenter et al. | 280/618 |
| 5,458,351 | * | 10/1995 | Yu | 280/87.042 |
| 5,474,322 | | 12/1995 | Perkins et al. | 280/613 |
| 5,480,176 | | 1/1996 | Sims | 280/618 |
| 5,499,837 | | 3/1996 | Hale et al. | 280/607 |
| 5,520,406 | | 5/1996 | Anderson et al. | 280/624 |
| 5,553,883 | | 9/1996 | Erb | 280/607 |
| 5,556,123 | | 9/1996 | Fournier | 280/607 |
| 5,577,755 | | 11/1996 | Metzger et al. | 280/607 |
| 5,584,492 | | 12/1996 | Fardie | 280/14.2 |
| 5,586,779 | | 12/1996 | Dawes et al. | 280/14.2 |
| 5,765,853 | | 6/1998 | Erb | 280/607 |
| 5,791,678 | | 8/1998 | Perlman | 280/618 |
| 5,865,446 | | 2/1999 | Kobalenski et al. | 280/14.2 |
| 5,876,045 | | 3/1999 | Acuna | 280/14.2 |
| 5,947,488 | | 9/1999 | Gorza et al. | 280/14.2 |
| 5,975,554 | | 11/1999 | Linton | 280/607 |
| 5,984,325 | | 11/1999 | Acuna | 280/14.2 |

OTHER PUBLICATIONS

Marked AR Nov. 3, 1997 Design News Magazine Upper R.H. Corner p. 50 "Designer's Corner" col.

Marked AS Before 1999 RipN, Inc.—Brochure Upper R.H. Corner.

Marked AT Before 1999 Fly Trap Bindings, Inc. Upper R.H. Corner—Brochure.

* cited by examiner

*Primary Examiner*—Michael Mar

(57) ABSTRACT

A method of operation and sportingboard foot or boot binding system that has two pivot mount plates (74) which are able to rotate free of a sportingboard (68), and which are connected by a rotational transmission means to cooperatively rotate both pivot mount plates (74) in the same direction. The sportingboard (68) can be a snowboard, wakeboard, mountainboard, surfboard or similar device that utilizes foot or boot mounting means of rider attachment. Braking or limiting devices can be employed to control the rotation of pivot mount plates (74).

18 Claims, 34 Drawing Sheets

DYNAMIC SYNCRONOUS PIVOTING BOOT AND FOOT MOUNTING SYSTEM FOR SPORTINGBOARDS

BACKGROUND OF THE INVENTION

The present invention relates generally to sportingboard boot binding and foot-retaining mechanisms and more particularly to those types of bindings and mechanisms capable of adjustment.

BACKGROUND—DESCRIPTION OF THE PRIOR ART

Sportingboards such as air-boards, sand-boards, wakeboards, and snowboards have become more numerous since these sports have become more popular in recent years. Air boarding is accomplished with a snowboard or similar device and also requires an airplane and a parachute and is accomplished by gliding through the air using the board as a control device during the free-fall phase of parachuting. Sandboarding is accomplished with a snowboard or similar device and is done while descending sloped surfaces of sand dunes in desert areas. Wakeboarding is accomplished with a board which is similar to a snowboard, is done on water, and is similar to water skiing, as it is done typically while being towed. Snowboarding is done while descending snow covered slopes of hills and mountains using a snowboard. In these sports mentioned and other similar sports (some types of mountainboarding or surfboarding) where a rigid or semi-rigid sportingboard is used in conjunction with boot bindings or foot-retaining mechanisms the present invention can be employed. Since a significant application of the present invention is snowboarding the discussion regarding the prior art shall mainly discuss snowboarding. In general many principles of operation which apply to snowboards apply to other types of sportingboards also.

Snowboarding is a relatively new sport that has grown in popularity over recent years. Snowboarding can be visually compared to skateboarding and surfing, except that it is done on snow. Snowboarding can also be compared to skiing, to the extent that the sport is practiced on snow-filled slopes. To snowboard, the rider stands on the board so that both feet are positioned at an angle substantially perpendicular to the longitudinal axis of the snowboard (the direction of travel). This position is desirable because it allows the snowboarder to roll back and forth on their heels and balls of their feet in order to change the surface impression of the board in the snow, thereby enabling the snowboard to turn. In order to maintain this position, protective boots are worn by a snowboarder and mounted to a binding that is fixedly bolted to the top surface of the snowboard at the desired angular position. Thus, it can be said that the sport of snowboarding is distinct from skiing, wherein both feet are side by side on a single ski and the skier faces forward.

Basically three types of bindings are commonly used in snowboarding, the high back, the plate, and a variation of the two, the step-in. The high back is characterized by a vertical plastic or aluminum back piece that is used to apply pressure to the heel side of the board. This type of binding typically has two straps that go over the foot, one holding down the heel and the other holding down the toe. Some high backs further include a third strap on the vertical back piece, called a shin strap, which gives additional support and aids in toe side turns. Typically this type of binding mechanism is used in conjunction with soft-shell boots. The plate, or step-in binding, is used with a hard shell boot much like a ski binding except it does not automatically release on impact of the board against an obstacle. A variation of these two types is the step-in binding.

Step-in bindings are designed to allow a rider to use soft-shell boots with out having to attach and detach straps each time one wants to exit the board. This is accomplished by having a reinforced soft-shell boot that attaches directly to a complimentary mated plate. A lever, button, or other rider-actuated release device is attached to the plate portion of the matched boot and (companion) plate set. These are also known as quick release bindings and have been gaining in popularity in recent years. Some of these step-in bindings resemble a plate binding since they have no vertical plastic or aluminum back piece while other step-ins have a back piece, but no boot straps.

During different events, snowboard riders have different angular positions of their feet relative to the longitudinal axis of the snowboard to accommodate different snow conditions or snowboarding styles. For instance, during speed runs such as Giant Slalom (GS) the snowboarder would prefer to have their feet oriented more relatively straight ahead, and thus more in line with the longitudinal axis of the snowboard. For other events such as freestyle and half-pipe events, the desired angle would be oriented more perpendicular to the longitudinal axis.

Snowboard types can be classified into two basic types: the directional and the twin. The directional board is essentially non-symmetrical with regard to the tips or ends of the snowboard, and designed to travel primarily in one direction relative to the longitudinal axis of the board. An example of a directional board is the GS type board. The twin is essentially symmetrical with regard to the tips or ends of the board. Thus the twin board is therefore better suited to reverse direction of travel with regard to the longitudinal axis of the board. An example of a twin type board is one that is used in freestyle or half-pipe events.

Originally all or most snowboards were directional. As snowboarding and other related sports have evolved the trend has been toward twin boards since riders continually "push the envelope" of the sport, and riders have discovered that one can ride "backwards" from the primary direction of travel. It is not the preferred direction of travel for the operator, nor is the stance of the rider relative to the board most conducive to operation in the backward direction. However when riding half-pipe and "trick courses" in snowboard parks the duration of travel in the backward direction is usually adjusted accordingly.

Typical prior art snowboard bindings have not been easy to rotate and lock at different angular positions while snowboarding. This is primarily due to the fact that typical bindings are attached either directly or indirectly with mechanical fasteners which essentially "lock" the binding to the snowboard. This is accomplished typically with threaded mechanical fasteners that mate with inserts or plates that are embedded within the snowboard.

Some prior art designs have mechanical fasteners that attach a binding directly to a snowboard through holes in the binding directly. In such direct type mounting bindings the binding and/or the snowboard has multiple fastener hole locations. This type of binding is shown in FIG. 2 of the drawing figures and is labeled "PRIOR ART". Other common designs employ a mating conical geared or toothed disc that engages, traps, and retains a binding. Such a disc is fastened to a snowboard directly through fastener holes that are in the disc. This type of binding is shown in FIG. 1 of the drawing figures and is labeled "PRIOR ART". The disc retains and prevents rotation of the binding. In these "disc locking" types of designs the disc hole pattern is repeated in predetermined locations/intervals on the snowboard. In both of these basic designs the fasteners must be dealt with for adjustment.

Typically to make a binding adjustment/reorientation for these designs the user must first remove the boot from the binding and then loosen a series of screws/fasteners, typically with a screwdriver or wrench, so that the binding can be rotated and positioned at the (new) desired angle. The loose screws must be re-tightened to lock the binding in place and the user can then reinsert the boot into the binding. Such an operation is difficult, time consuming, and inconvenient for the snowboarder. This is impractical when the loss of screws/fasteners in the snow and the consideration of the cold environment is taken into account. Though somewhat impractical snowboarders do perform such a field operation on snowboards, and portable tool kits have been designed for this purpose. Thus field adjustments with typical prior art bindings are possible, but undesirable.

Typically there has been a compelling need to easily adjust the rotation of the leading/primary binding while snowboarding. This is due to various safety, comfort, and operating issues confronting riders of snowboards having typical prior art bindings:

1) Moving on non-sloped areas: Before and after snowboarding down a slope, a user typically releases their rear (non-leading) boot, and pushes along with this free foot to move the snowboard. Such action is similar to that performed by a skateboarder to move forward on flat surfaces, and hence is called "skating." However, unlike skateboarding where both feet are free, the snowboarder's front foot is fixed at an awkward and inconvenient angle (i.e., almost perpendicular to the direction of the travel). Consequently, it is difficult to achieve efficient forward locomotion, and a great deal of torque is induced on the front knee.

2) Mounting and dismounting a ski lift: The inconvenient angle of the rider's primary/leading foot poses a balance/control problem when a snowboarder mounts or dismounts a ski lift. Snowboarders typically engage the ski lift with the same foot-binding configuration used while propelling themselves, that is, with the front (leading) foot mounted in the forward binding, and rear foot released. Due to the unnatural orientation of the snowboarder's mounted foot, it is difficult for the snowboarder to rapidly mount and dismount a ski lift. This imbalance/lack of control causes accidents and delays at the base and top of ski lifts.

3) On a ski lift: On a typical chair lift, the riders sit side by side facing the direction of travel of the chair lift. Therefore, the front foot of the snowboarder points in this direction as the snowboarder sits on the chair lift. Since the front foot is still mounted on the binding, the snowboard extends at an angle substantially perpendicular to the direction of travel of the chair lift, thus interfering with the skis or snowboards of other riders. A snowboarder can alleviate this problem by rotating their front foot in order to point the board straight ahead. However, this induces torque on the knee and ankle and thus is very uncomfortable, fatiguing, and stresses the soft tissues of the joints. Moreover, such twisting and contorting by the snowboarder increases the chance of passengers or equipment falling from the lift.

Thus there has been a need to provide a binding system that adjusts the leading binding to alleviate these conditions mentioned and others. Further, it has been realized that, in general, it is desirable to be able to adjust both bindings. The prior art discloses numerous designs to eliminate the problems associated with adjusting foot positions on a snowboard:

For example, U.S. Pat. No. 4,871,337 issued to Harris on Oct. 3, 1989, discloses a riding apparatus, such as a water ski board or snow ski board, in which the rider's feet are positionable within bindings formed on first and second riding plates. Each riding plate is positionable above a channel section formed within a rider support surface of the riding apparatus. Fasteners supported by each riding plate are releasably engageable with retaining elements installed within the channel section. After loosening the fasteners from the retaining elements, each riding plate may be repositioned angularly or longitudinally with respect to its channel section, thereby permitting the apparatus to be used with a variety of stances and leg spacings.

U.S. Pat. No. 4,964,649 issued to Chamberlin on Oct. 23, 1990, discloses a rider responsive boot binder attachment mechanism that enhances the maneuverability and responsiveness of a snowboard. A pair of first plate members is secured in spaced relationship to the snowboard. A pair of second plate members is rotatably secured, one each, to the first pair of plate members and boot binder mechanism attached to each of the second plate members at the desired angulation therewith. An elastomeric structure in the form of elongated spiral springs is disposed between each connected first and second plate to limit relative rotation therebetween and to exert a force on the plates to effect return to an original preset position after the plates have been rotated relative to each other by rider applied torque action. Adjustment mechanism is provided in each boss and stop element disposed at each end of each spring to adjust the effective length of each spring and thereby regulate the initial compression or tension exerted by each spring. A ball bearing assembly facilitates relative rotation between the first and second plate members.

U.S. Pat. No. 5,085,455 issued to Bogner, et al. on Feb. 4, 1992, discloses a snowboard that has two boot bindings in the form of plate bindings arranged at a considerable angle to the longitudinal direction of the board. The release mechanisms of the two plate bindings are coupled together in such a way that during release of the one plate binding the release force for the other respective plate binding is at least substantially reduced.

U.S. Pat. No. 5,277,635 issued to Gillis on Jan. 11, 1994, discloses a skiboard system comprising a skiboard having a channel extending along a portion of the length thereof and two bindings secured, via the channel, to the skiboard. The bindings are designed to be rotated between a locked starting position, where the long axes of the bindings extend parallel to the long axis of the skiboard, and a locked skiing position, where the long axes of the bindings extend transversely to the long axis of the skiboard. After the bindings have been rotated to a selected position, the bindings are secured in place via a locking mechanism that is operated by movement of a pivotally mounted handle.

U.S. Pat. No. 5,299,823 issued to Glaser on Apr. 5, 1994, discloses a snowboard binding assembly comprising a fixed jaw to engage one side of a boot, and a slide jaw assembly to engage an opposite side of the boot. An operating lever positions a slide jaw housing in a locking mode where the slide jaw assembly is fixed in locking engagement with the boot, an intermediate step-in position where the slide jaw housing can move laterally to a release position, and a disengaging position where the slide jaw housing is either positively moved to the release position or can readily be moved to the release position in opposition to the spring.

U.S. Pat. No. 5,354,088 issued to Vetter, et al. Oct. 11, 1994, discloses a coupling for releasably mounting a boot with boot binding to a turntable which is adjustably secured to a snowboard. The boot binding includes a plurality of extending lock pins each with a shoe releasably locking into arcuate slots in the turntable. The boot binding is quickly directed to the coupling with a set of guide pins protruding from the boot binding. Also extending from the boot binding plate is a latch pin held under spring bias which when aligned in a hold position, fits into one of several latch pin holes in the turntable. To release the plates from the hold position, the latch pin is pulled from the latch pin hole by a flexible hand extension release device hand operated from a standing position and the plates are rotated to disengage the shoes from the arcuate slots.

U.S. Pat. No. 5,356,170 issued to Carpenter, et al. on Oct. 18, 1994, discloses a snowboard binding system having a binding plate, the bottom of which is supported on a snowboard. The plate includes a circular opening in its center that receives a disk shaped hold-down plate. The hold-down plate may be secured to the board in several different positions with the binding plate assuming any rotational position with respect to the hold-down plate. Additionally, a highback support attached at the rear of the binding plate may be rotated along an axis generally normal to the binding plate and secured in its rotated position, to enable a rider to transmit forces to the snowboard from a variety of stance positions.

U.S. Pat. No. 5,474,322 issued to Perkins, et al. on Dec. 12, 1995, discloses a snowboard binding that can readily attach and release a boot from a snowboard. The binding includes a binding housing that is mounted to the snowboard. The housing has a pair of pin holes to receive locating pins which extend from the sole of a boot. When the snowboarder inserts the pins into the holes, a pair of locking pins extend through apertures in the locating pins to secure the boot to the board. The locking pins are coupled to a lever that can be rotated by the user. Rotation of the lever moves the locking pins out of the locating pin apertures so that the boot can be detached from the board. The binding housing includes a base plate that is mounted to the snowboard and a cover plate that contains the locking pins and release mechanism. The cover plate is coupled to the base plate by a tie down bolt that can be unscrewed to allow rotation of the cover plate relative to the board. Rotating the cover plate also rotates the pin holes and the corresponding foot position of the snowboarder.

U.S. Pat. No. 5,480,176 issued to Sims on Jan. 2, 1996, discloses a snowboard binding system which includes a toe strap, an ankle strap, a heel loop and two pods. The pods, mounted to the surface of a snowboard, are located at the outside footprint of the rider's boot. The pods allow the snowboard rider to rotate the binding to various angles, to adjust the width of the binding to accommodate their foot and to modify the distance between the two bindings to accommodate the rider's stance. In addition, the rider's center of gravity is lowered, thereby increasing the rider's sensitivity to the board and enabling the rider to hold a better edge while turning.

U.S. Pat. No. 5,499,837 issued to Hale, et al. on Mar. 19, 1996, discloses a swivelable mount for the boot bindings of a snowboard or the like. The mount includes a low profile housing with walls enclosing a cylindrical cavity, the housing bottom having a bore concentric with and smaller in diameter than the cavity, the bore being surrounded by an upward-facing annular surface, the housing top adapted for the mounting of a boot binding. A circular member for rotatably mounting the housing is secured to the snowboard and has a stem journaled in the housing bore and a larger diameter cap fitting in the housing cavity. The cap provides a downward-facing annular flange positioned opposite the upward-facing annular surface of the housing, and prevents upward movement of the housing from the snowboard. A circular locking plate rotatably mounted in the cavity above the top of the housing mount has a top surface characterized by a plurality of radially extending undulations, and the top wall of the housing cavity is provided with a similar undulating surface. The two undulating surfaces are slidably engaged. The plate has a first rotational position where the two undulating surfaces mesh, corresponding to an unlocked, rotatable condition of the housing. A lever, mounted to the housing can rotate the locking plate, moving the two undulating surfaces from a meshed position to an un-meshed position, resulting in relative axial movement of the housing, engaging the opposing annular surfaces and preventing housing rotation.

U.S. Pat. No. 5,520,406 issued to Anderson, et al. on May 28, 1996, disclsoses a binding assembly for attaching a boot to a snow board, designed in a manner to avoid cavities that can accumulate ice and snow and defeat its operation. The system includes first and second boot mounted bales in the form of rigid loops extending from each side of the boot soles, and a pair of bindings attached to the snow board. Each binding has a base including elongated, slotted holes located on the circumference of a circle through which bolts are placed to secure the base to the snow board with a friction washer therebetween. The elongated holes allow for rotational adjustment of the binding. A spring loaded latch is pivotally mounted outboard and above the notch and includes a lever with a generally outwardly protruding handle on one side of the lever pivot axis, and a bale latching portion on the other side of the pivot. In order to release the binding, the user simply rotates the latch upward to free the bales.

U.S. Pat. No. 5,553,883 issued to Erb on Sept. 10, 1996, discloses a binding that attaches a user's foot to a snowboard and includes a footplate rotatably and continuously fixed to the snowboard and which is attached to the user's foot via straps and a rear support which contacts a snowboot. An anchor fixes the footplate to the snowboard with the bottom of the footplate as close to the snowboard as possible whereby the bottom of a snowboarder's foot is as close to the plane of the snow as possible, and is slidably engaged with the footplate to permit that footplate to rotate while remaining attached to the snowboard. Anti-pivot spring pins located outside the outer perimeter of a user's snowboot accurately and repeatably secure the footplate to the snowboard once the footplate is in the selected angular orientation on the snowboard.

U.S. Pat. No. 5,556,123 issued to Fournier on Sept. 17, 1996, discloses a snowboard boot binding comprising a base adapted to receive a boot, an in-step pad adapted to cover the top of the boot, a rear support adapted to cover a heel and the back of the boot, the rear support being pivotedly mounted at the base. The in-step pad is attached to the base via tension cables passing through the sides of the base, coming out under the base below a pivot point and being attached to the rear support and progressing longitudinally along the rear support. The rear support is maintained in a vertical position by a spring loaded lever.

U.S. Pat. No. 5,577,755 issued to Metzger, et al. on Nov. 26, 1996 discloses a rotatable binding for a snowboard which includes a base plate on the snowboard and a binding plate rotatably mounted on top of the base plate. The binding plate includes a foot binding and a locking assembly for selectively locking, at a desired angle of rotation, the binding plate to the base plate. The locking assembly includes a pin selectively moveable from a raised position, not restricting rotation of the binding plate relative to the base plate to a lowered position engaging an indexing bore such that the binding plate may not rotate relative to the base plate.

U.S. Pat. No. 5,584,492 issued to Fardie on Dec. 17, 1996, discloses an adjustable snowboard binding assembly which can be rotatably controlled without the use of external tools. A snowboard boot-mounting platform has a plurality of inwardly facing radial teeth along the circumference of a centralized circular cutout. A circumferential lip along the cutout is used to rotatably mount the platform via overlapping lipped quadrant segments which mount to the snowboard. A pair of radially sliding segments with teeth at their outer ends are slidably held by said quadrant segments. A slidable band is mounted via actuating/locking levers along the longitudinal length of the snowboard, with said band having upwardly extending posts which interface with angled slots formed in each sliding segment. In operation, the actuating levers are unlocked and the band slides forwards and backwards to effectuate radial movement of the sliding segments. This in turn effectuates locking engagement and disengagement between the radial circumferential teeth and the sliding segment teeth.

U.S. Pat. No. 5,586,779 issued to Dawes, et al. on Dec. 24, 1996, discloses a snowboard boot binding device comprising a binding mount plate for fixedly mounting a snowboard binding thereto, said binding mount plate having a cavity centrally defined therein, a ring fixedly attached to said binding mount plate containing a bore centrally defined therethrough, a hub for mounting said boot binding device to a snowboard, said hub being centrally disposed in said cavity and extending through said bore, wherein said binding mount plate is free to rotate about said hub, thereby allowing for adjustment of an angular position of said binding mount plate, and locking means for arresting and releasing rotation of said binding mount plate, thereby allowing the angular position of said binding mount plate to be adjusted.

Notwithstanding, these developments regarding the adjustment of bindings all address different problems than that which the present invention addresses. The present invention primarily addresses significant limitations inherent in all sportingboard binding designs known in the prior art. However these significant limitations to date have been unrecognized, and consequently the present invention is the first to provide a solution.

Typically operators of snowboards prefer to have one leading foot predominantly oriented more in line with the longitudinal axis of those sportingboards. Consequently this leading foot binding is less perpendicular to the longitudinal axis than the trailing foot. A common operator preference is to have one's front foot positioned at an angle approximately 45 degrees with respect to the longitudinal axis of the snowboard. Consequently this leading foot, which also leads relative to the direction of travel, determines what is called in these sports the way an operator "shoots". This preferred foot orientation thus establishes the direction of riding or "shooting" as it is often called. If, for example, the orientation is left foot forward, this orientation is typically called shooting "regular". If a rider prefers to ride with their right foot forward, this orientation is typically called shooting "goofy". Thus in both rider orientations the rider's body is slightly oriented more naturally to point toward the primary direction of travel, as the lower limbs influence the position of the torso of the body.

Snowboard riders continually have been experimenting with the extreme limits of the sport, expanding the operational limits with equipment designs. Since the growth in popularity of the half-pipe in snowboarding "twin tip" or twin (symmetrical) boards have evolved. This allows riders to move in a backward direction of travel relative to their preferred direction of travel.

This design allows greater freedom in stunts and "trick maneuvers" especially when launching and landing in airborne or jumping feats. Thus one can become aloft from a "goofy" travel direction and land in a compromised "regular" travel direction. The term compromised is used since two prevailing conditions intrinsically limit such a landing maneuver:

1) The landing direction of travel is not the preferred one, and is thus a "strength compromise" of the rider.

2) The angular orientation of the feet relative to the new (backward) direction on landing is opposite of the naturally required one for the torso, and is thus an "orientation compromise".

These two factors in combination continually impose limitations when riding freestyle. These limitations are particularly present during freestyle type events such as flips, spins, "walking", jumping and other condition specific and unique maneuvers that utilize a change in direction of travel. Additionally the ability to change direction of travel in regular snowboarding and other sport-boarding is also limited or compromised during general operation. Broad, sweeping, arcuate turns (which are more gradual) are also restricted, though it may not be readily apparent to the rider turning. Freedom to maintain contact with the sportingboard and simultaneously pivot one's torso while traveling in a relatively continuous direction is limited also. Riders of sportingboards have just accepted these restrictions and limitations as a necessary part of these sports.

In wake boarding, for example, essentially the same limitations exist. In a way the half-pipe is replaced by the (grooved) wake of the pulling vessel/boat. Similar type stunts are performed, albeit while connected to a pulling towrope or similar. Spins, flips, "reversals", jumping and other condition specific and unique maneuvers are executed, again under "compromised" conditions. There is also a preferred direction of travel relative to the foot stance. Thus similar limitations exist with present wake-board type sportingboard-binding systems.

Regardless of the design, all prior art sportingboard binding systems lack a means to compensate for a reversal in the direction of travel. Additionally all prior art sportingboard binding systems are restrictive and lacking with regard to degrees of freedom of the foot position, and hence body position, relative to the sportingboard—during general operation. None of the prior art is seen to describe the present invention as claimed. Therefore, a sportingboard boot binding mechanism that allows dynamic adjustment of foot orientation during travel would be beneficial.

SUMMARY

In accordance with the present invention a sportingboard binding mechanism having foot bindings or boot bindings or mounting plates which are able to rotate relative to the sportingboard, and which are linked together by a rotational transmission means to cooperatively rotate in the same direction, thus able to be rotated simultaneously while riding.

Objects and Advantages

1) Accordingly, it is a principal object of this invention to provide a method of sport-boarding that allows a rider to dynamically and cooperatively pivot both foot bindings or both mounting plates of a sportingboard during riding, thus enabling greater freedom of movement in riding.

2) Accordingly, it is another object of this invention to provide a sportingboard binding mechanism that has two pivotable foot bindings or mounting plates, both of which are free to pivot during the riding of a sportingboard so equipped, and where these same two foot bindings or mounting plates are linked by a rotary transmission means or linkage mechanism to cooperatively rotate in the same direction at the discretion of the rider.

3) It is yet another object of this invention to provide a sportingboard binding mechanism which, according to the first and previously mentioned object, is enabled to dynamically adjust rider foot positions cooperatively while traveling, and additionally includes a means of adjusting the resistance of the foot bindings or mounting plates to rotation.

4) It is still another object of this invention to provide a sportingboard binding mechanism which, according to the first and previously mentioned object, is free to dynamically adjust rider foot positions cooperatively while traveling, and additionally includes a means for establishing rotational limits or stops for the foot bindings or mounting plates.

5) It is yet another object of this invention to provide a sportingboard binding mechanism which, according to the first and previously mentioned object, has the option to dynamically adjust rider foot positions cooperatively while traveling, and additionally includes a means for preventing rotational movement of the foot bindings or mounting plates.

The above and many other objects, features and advantages of this invention will be better understood from the ensuing description of selected preferred embodiments, which should be read in conjunction with the accompanying Drawings.

BRIEF DESCRIPTION OF THE DRAWING FIGURES

A brief description of the drawing figures follows. In the drawings, closely related figures have the same number but different alphabetic suffixes.

FIGS. 11A, 11B, 11C, & 11D are views of the present invention having a belt type rotary transmission means which is enclosed within a guard.

Figure 12:
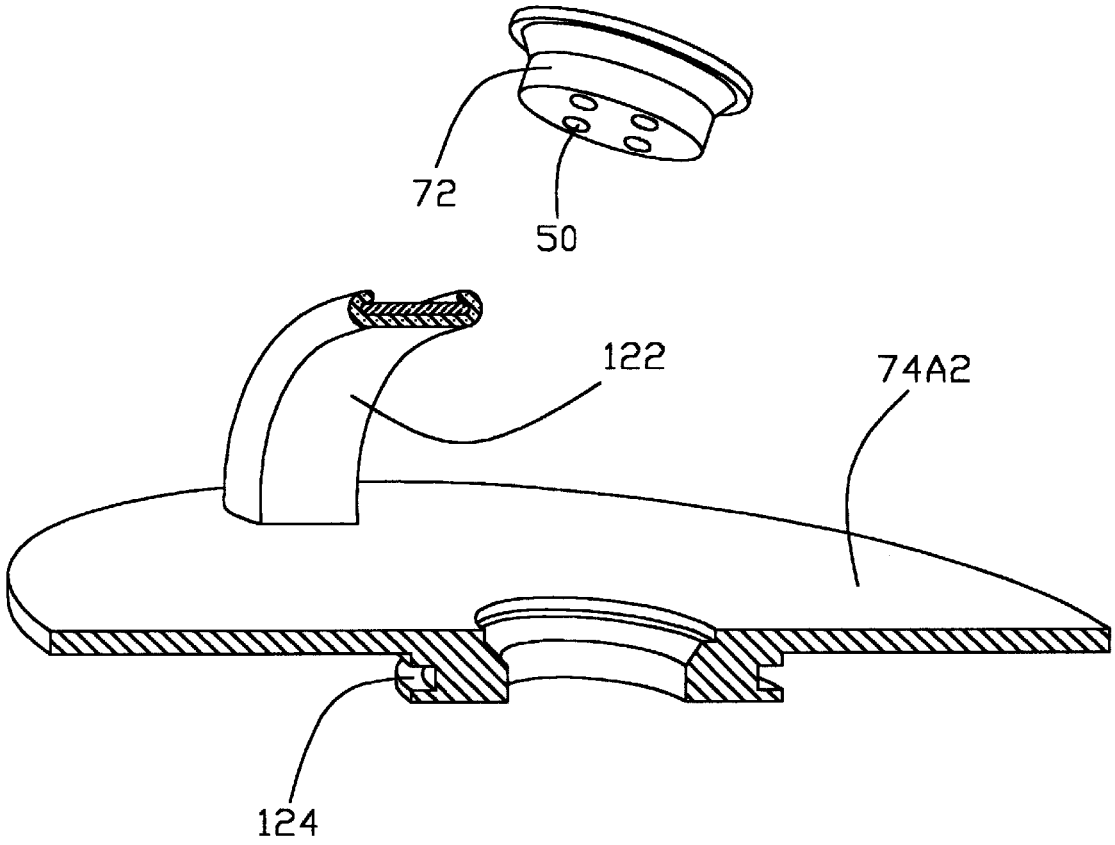

FIG. 12 is an oblique perspective, sectional view of a dynamic foot bracket of the non-locking disc type of the present invention.

Figure 13:
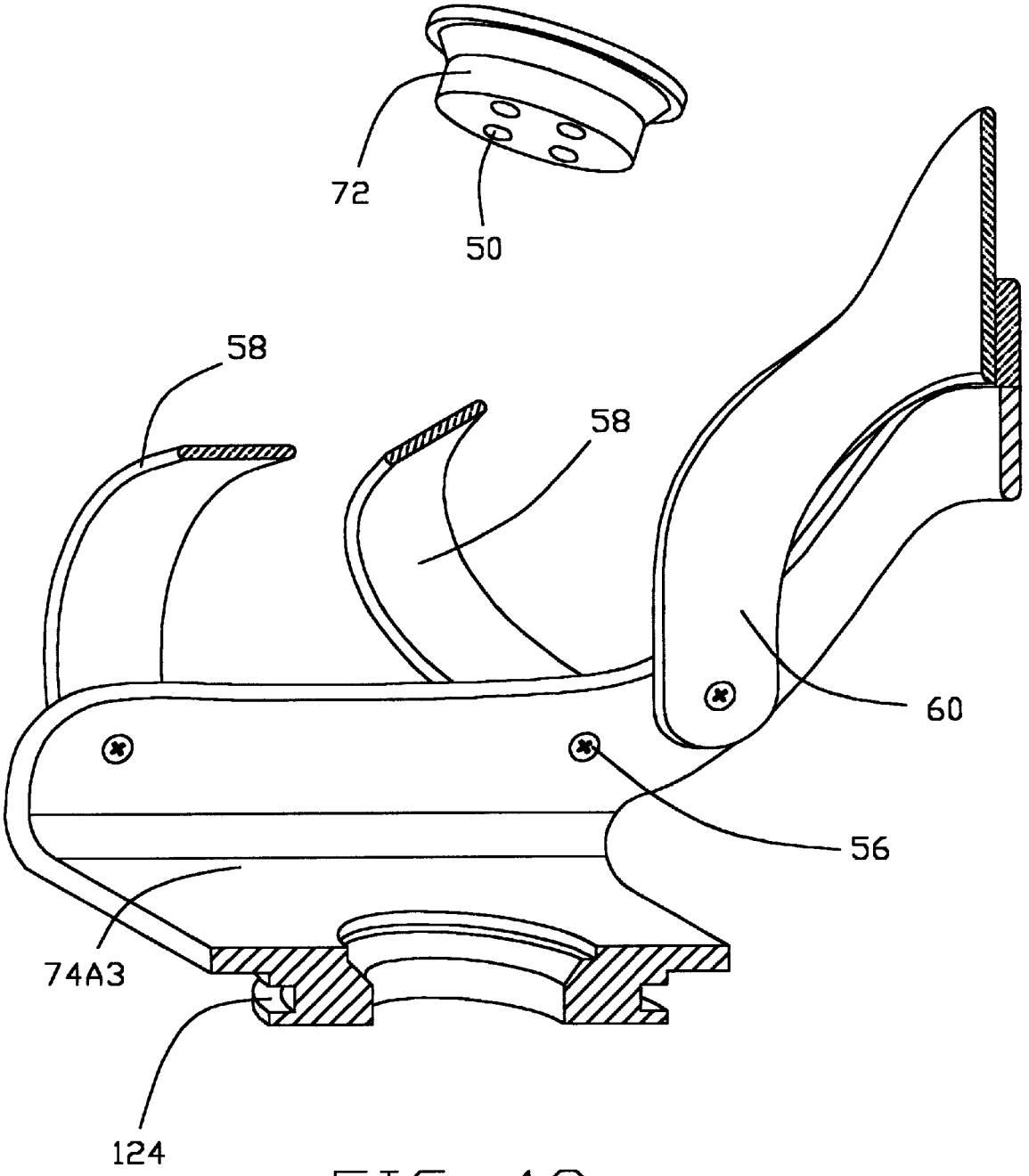

FIG. 13 is an oblique perspective, sectional view of a dynamic boot bracket of the non-locking disc type of the present invention.

Figure 14:
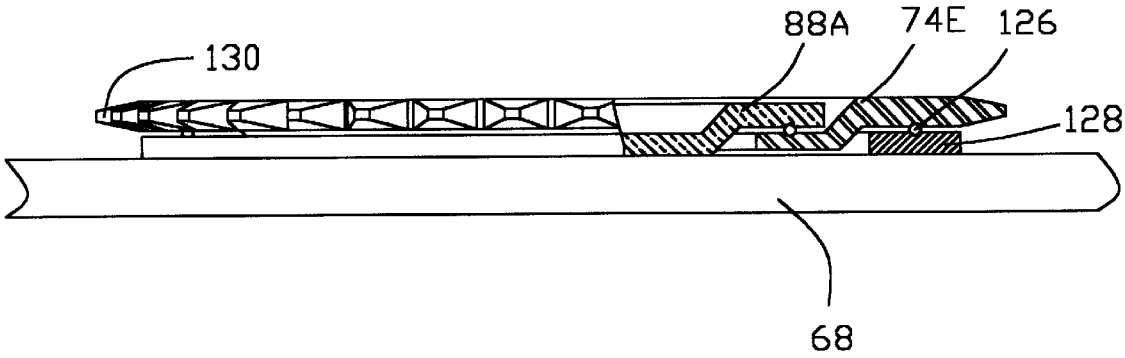

FIG. 14 is a partial, broken side view of the present invention showing a chain driven pivot mounting plate.

Figure 15:
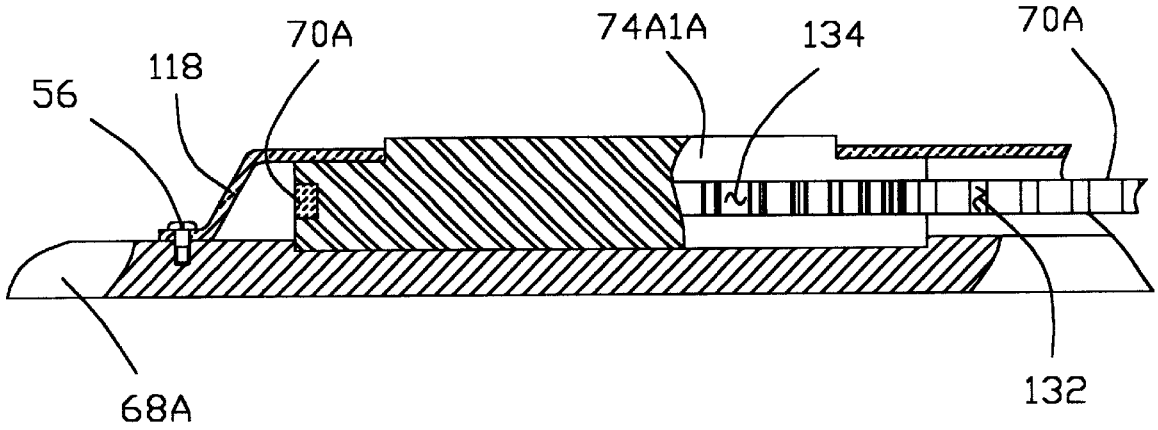

FIG. 15 is a partial, broken side view of the present invention showing a cog belt driven pivot mounting plate enclosed within a guard.

Figure 16:
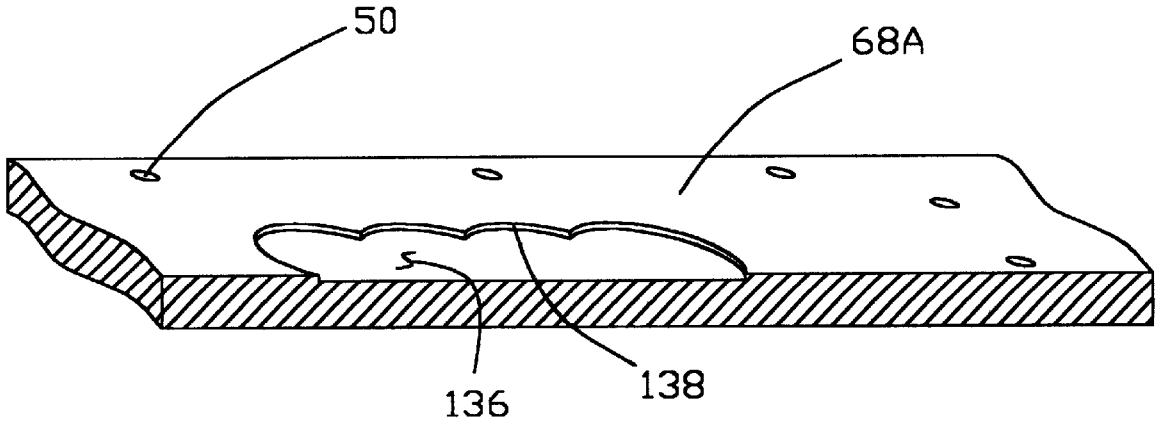

FIG. 16 is a partial, oblique perspective, sectional view of a sportingboard of the present invention having a recessed surface.

Figure 17:
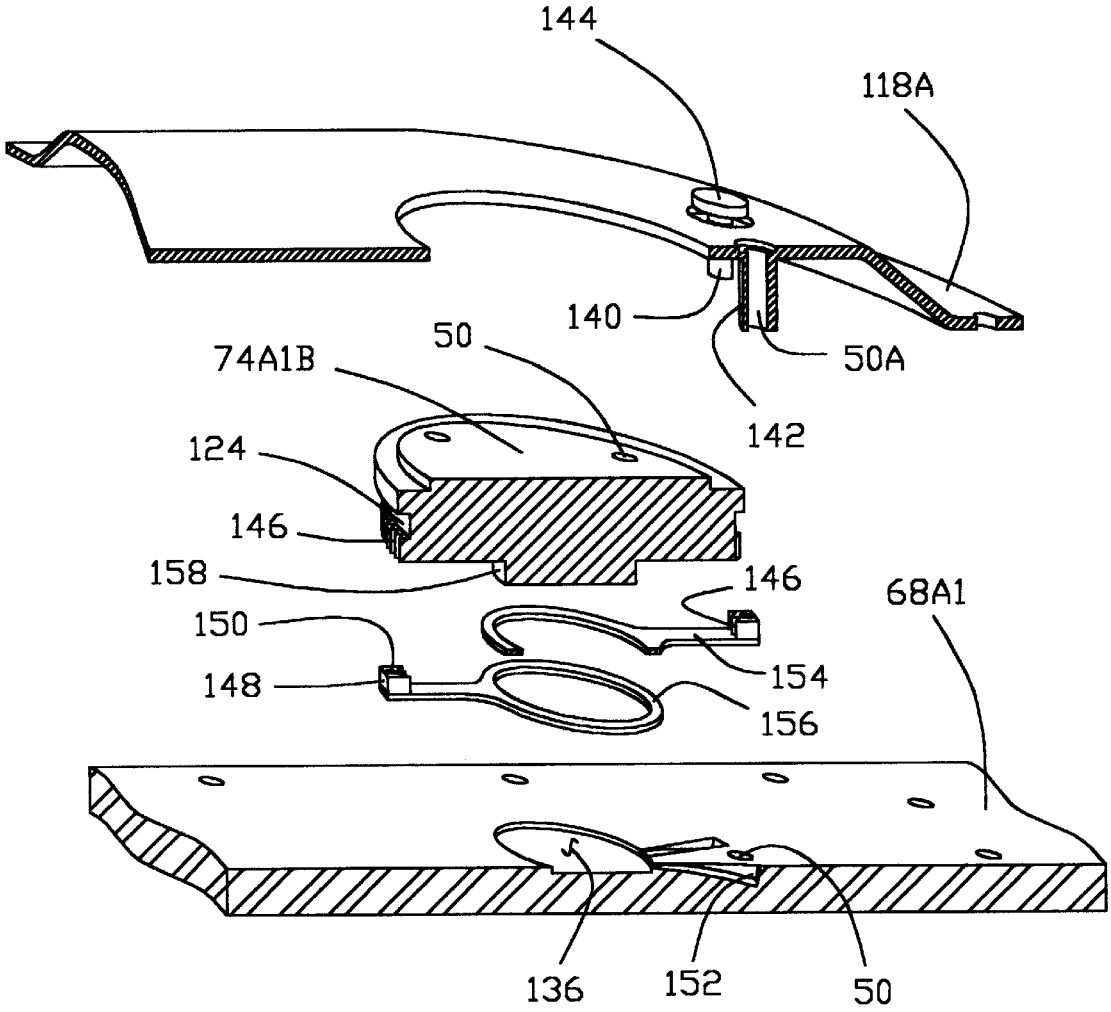

FIG. 17 is a partial, oblique perspective, sectional view that is "exploded apart" showing a sportingboard of the present invention having adjustable rotation stops and having a guard.

Figure 18:
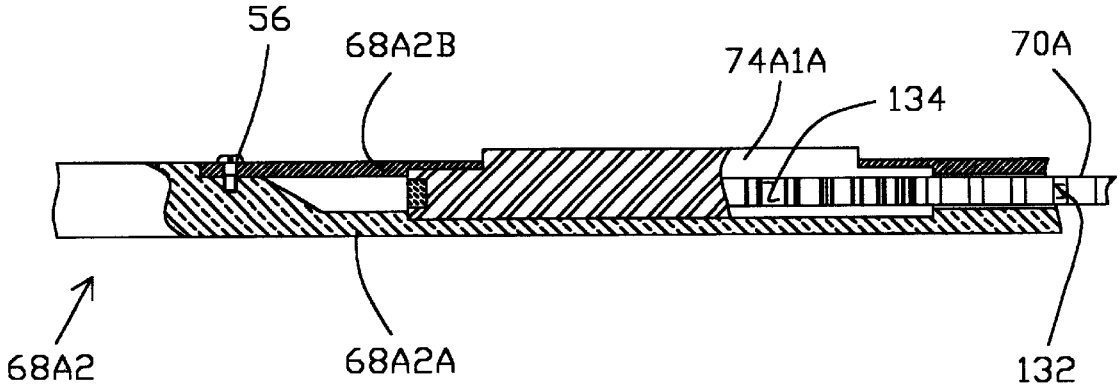

FIG. 18 is a partial, broken side view of the present invention showing a cog belt driven pivot mounting plate enclosed within a sportingboard having laminated type construction.

Figure 19:
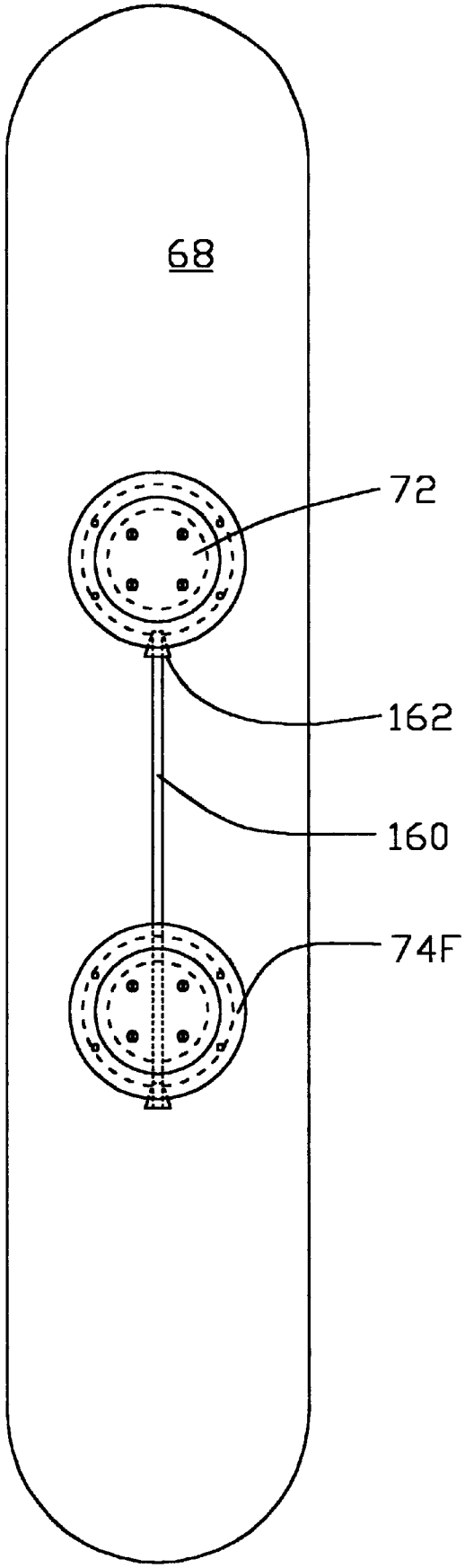

FIG. 19 is a top view of a sportingboard of the present invention having a gear shaft type drive system.

Figure 20:
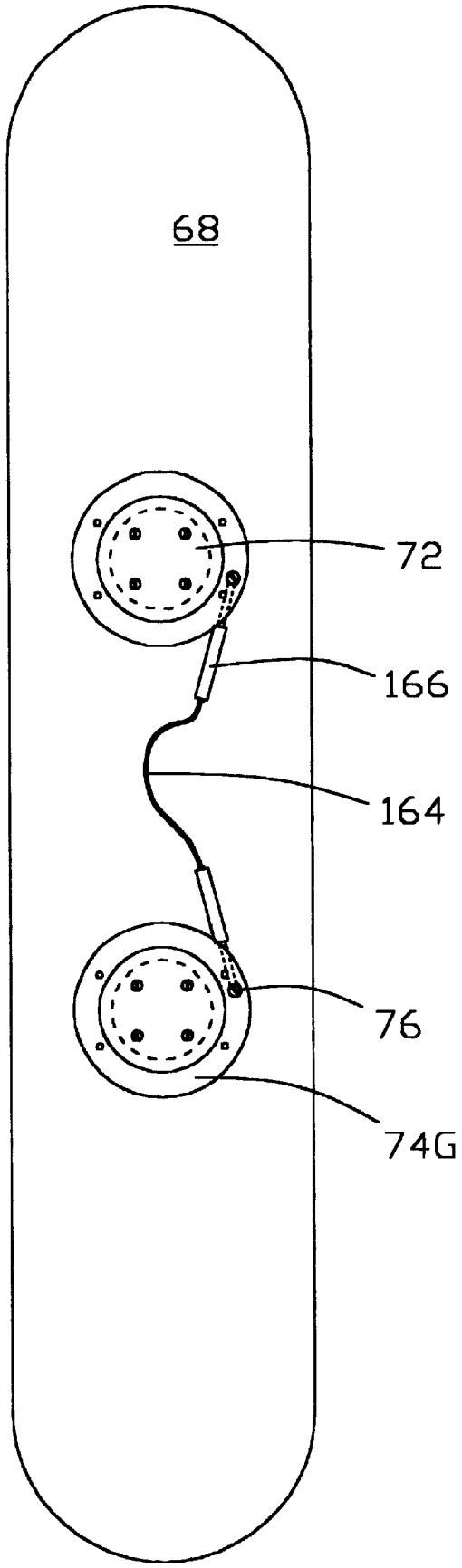

FIG. 20 is a top view of a sportingboard of the present invention having a fluid cylinder type drive system.

Figure 21:
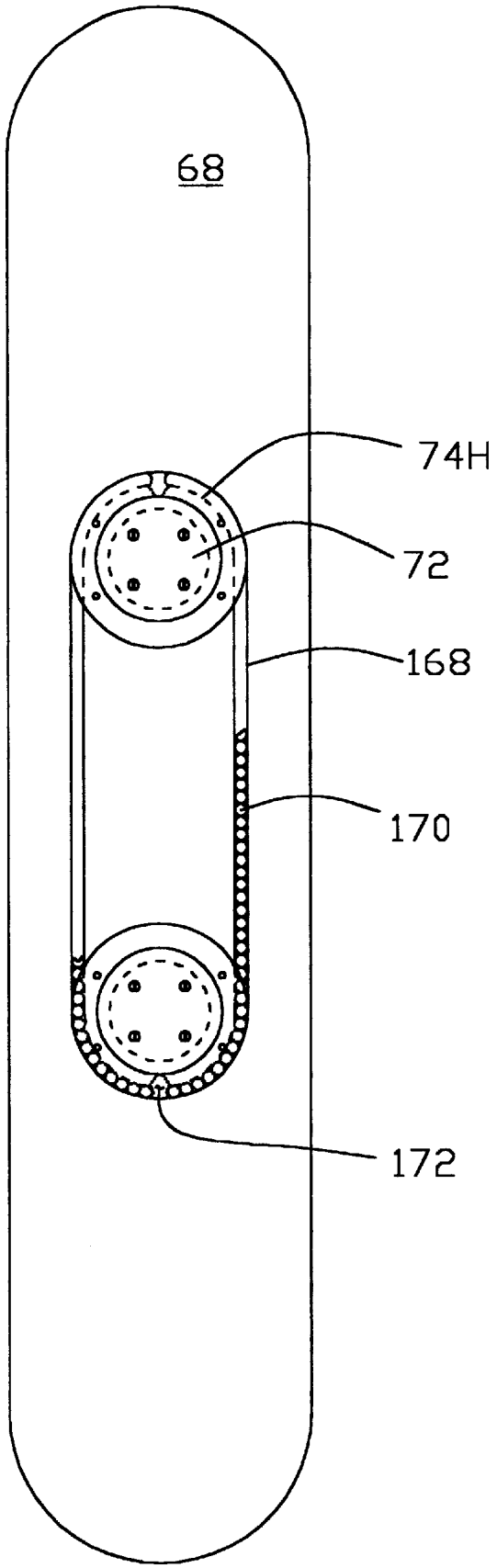

FIG. 21 is a top view of a sportingboard of the present invention having a ball transfer type drive system.

Figure 22:
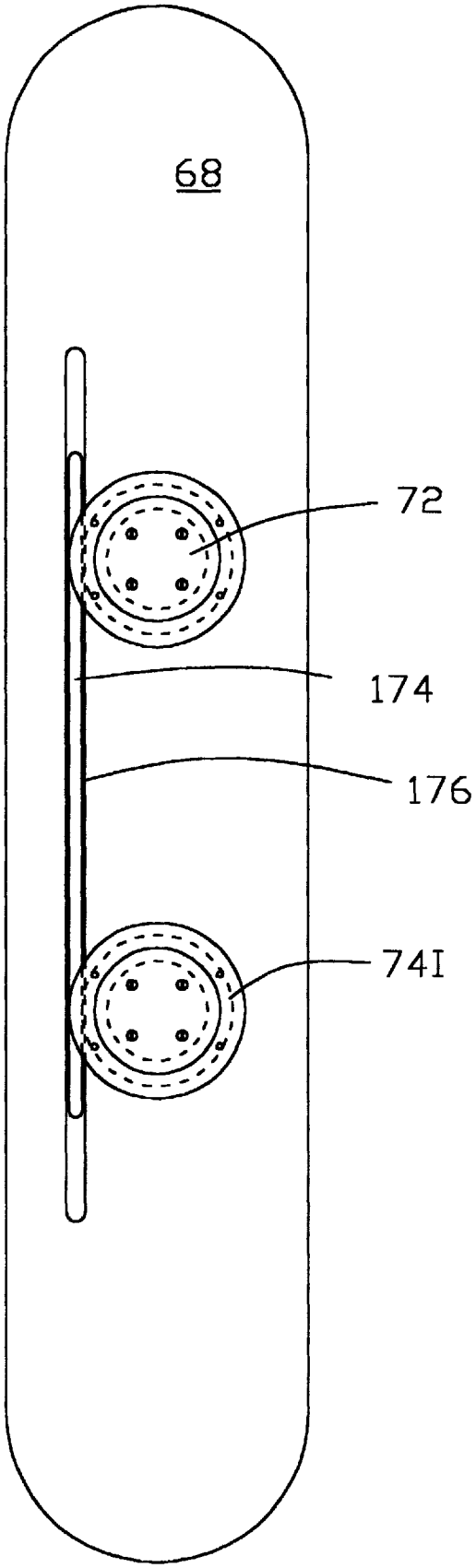

FIG. 22 is a top view of a sportingboard of the present invention having a rack and pinion type gear drive system.

REFERENCE NUMERALS IN DRAWINGS

50 fastener hole
50A fastener hole-reinforcing
52 locking retainer disc
54 locking tooth
56 fastener
58 boot strap
60 leg support
62 disc type fixed boot bracket
64 slotted type fixed boot bracket
66 slot
68 sportingboard
68A sportingboard-with recession
68A1 sportingboard-with recession-with tab relief groove
68A2 sportingboard-with recession-laminated
68A2A sportingboard-with recession-laminated-lower portion
68A2B sportingboard-with recession-laminated-upper portion
70 drive belt
70A drive belt-cog toothed
72 retainer disc
74A pivot mount plate-belt drive
74A1 pivot mount plate-belt drive-enclosed
74A1A pivot mount plate-belt drive-enclosed-with cog teeth
74A1B pivot mount plate-belt drive-enclosed-with indexing gear
74A2 pivot mount plate-belt drive-with integral foot strap
74A3 pivot mount plate-belt drive-with integral boot bracket
74B pivot mount plate-rod driven
74C pivot mount plate-cable driven

74D1 pivot mount plate-two piece-upper portion
74D2 pivot mount plate-two piece-lower portion
74D1A pivot mount plate-two piece-upper portion-with integral boot bracket
74E pivot mount plate-chain driven
74F pivot mount plate-bevel gear driven
74G pivot mount plate-fluid piston driven
74H pivot mount plate-ball driven
74I pivot mount plate-rack gear driven
76 large pivot pin
78 connecting rod
80 cable retainer end
82 cable sheath
84 cable housing bracket
86 cable
88 support flange
88A support flange-with bearing raceway
90 lever arm
92 brake pad
94 pull rod
96 adjuster nut-handle
98 small pivot pin
100 shear pin
102 spring tab
104 shear pin hole
106 coil spring
108 spring retainer clip
110 twist handle
112 twist handle stop
114 flip handle
116 flip handle nut
118 major guard-enclosure
118A major guard-enclosure-with pin and reinforcing boss
120 minor guard-enclosure
122 padded foot strap
124 drive belt groove
126 ball bearing
128 lower bearing race
130 sprocket tooth
132 drive belt tooth
134 cog wheel tooth
136 recessed surface
138 pivot plate edge guide
140 release pin
142 reinforcing boss
144 release pin head
146 gear tooth
148 locking lug
150 release pin dimple
152 tab relief groove
154 spring tab extension
156 base ring
158 pivot plate boss extension
160 gear shaft
162 bevel gear
164 fluid line
166 fluid cylinder
168 ball tube
170 ball
172 pivot plate ball stop
174 rack gear
176 rack gear guide

DESCRIPTION AND OPERATION

Description and Operation—General

Description—General

The present invention can be specifically embodied in many different formats but all complete and functioning embodiments essentially have at least the following basic components:

A sportingboard

Two pivotable foot mounting plates

A drive mechanism (or rotational transmission means) connecting the two pivotable mounting plates The sportingboard is any of the sportingboards used such as a wakeboard, snowboard, airboard, sandboard, surfboard, mountainboard or similar rigid or semi-rigid member having a principal mounting surface, allowing attachment of two pivotable foot mounting plates.

The two pivotable foot mounting plates are:

Attached to the sportingboard

Free to pivot independent of the sportingboard (or at least have the option to pivot) at the discretion of the rider while the board is stationary or is traveling Are able to receive an rider's foot either directly or indirectly—depending upon weather the rider is wearing boots or other footwear The drive mechanism (or rotational transmission means) connects the two pivotable foot mounting plates to cooperatively rotate in the same direction (i.e. clockwise or counterclockwise) at the discretion of the rider.

Regarding materials of construction:

Materials can be used which are conventionally used in the prior art for sportingboards and foot mounting plates, with consideration to fact that they are now dynamic instead of static. Thus for moving parts factors such as the coefficient of friction and other wear and dynamic stress properties are to be considered. The drive materials are also conventional for their respective art and not necessarily within the sportingboard industry but will be discussed in the accompanying drawings for each respective embodiment. In general, however the materials of choice for the sportingboard and foot mounting plates will be conventional materials used in the prior art and/or chosen from the families of materials such as:

Aluminum (and its alloys)

Stainless steel (and its alloys)

Carbon steel (and its alloys)

Fiberglass (various weaves and resins)

Wood (various species and physical configurations)

Foam (various closed and open cell types)

Nylon resins

ABS resins

Polyurethane resins

Acetyl resins

Polyester resins

Polypropylene resins

Polyetherimide resins

Polycarbonate resins

Polyphenylene sulfide resins

The above listed resins can have additives to improve strength, friction, thermal stability, creep, . . . etc. Additives for the resins can be fiberglass, carbon fiber, P.T.F.E., . . . etc. Other materials can be used which are known to those skilled in the art of sporting boards and sportingboard bindings, and/or typical to the art of the drive system embodiment employed.

Operation—General

While operating a sportingboard of the present invention the rider has the option of pivoting their feet while traveling over air or land or water. Essentially both feet must pivot at the same time and in the same direction. The ratio of rotation is essentially one to one but in some optional embodiments operators may have a preference for ratios that are not one to one. A reason for this and an example of this would be where an operator shooting goofy might have a terminal (extreme rotational limit) foot position that if rotated to a regular position would not be their preferred regular position. In such a case the drive linkage/rotary transmission means connecting the two foot mounting plates could be arranged to cooperate in a ratio of other that one to one. By a ratio of one to one the results obtained are, for example, essentially 15 degrees of rotation clockwise for the left foot mounting plate produces 15 degrees of rotation clockwise for the right foot mounting plate.

The rider provides the acceleration force that drives the foot mounting plates. This can be done either while traveling ("board is dynamic") or while stopped ("board is static"). If the board is stopped the rider executes a movement similar to a partial "left face" or "right face" military facing movement by the pivoting of both feet. The feet however are attached (and thus constrained) to the board via the pivot mount plates. Further the rider doesn't pivot significantly on the ball of one foot and the heel of the opposite foot, but each foot pivots about an axis which is located essentially more central to each respective foot, between the heel and toe, and which is essentially perpendicular to the board. While traveling this method can be used in combination with other techniques.

While traveling on a sportingboard the above method can be used but other techniques are available to riders. A rider can "shuffle their feet" moving one foot in the direction the toe (or heel) points, while moving the other foot in the opposite direction or keeping it stationary. This is a movement similar to when one is seated in a high chair or swing, with legs dangling downward (above the ground and free), and one can kick or swing each respective lower leg portion simultaneously in opposite directions, forward or backward. Thus by driving one foot forward and the opposite foot backward a repositioning of the feet is obtained and the dynamics of the overall movement of the rider relative to the direction of travel is obtained. There is another method of utilizing the present invention to control operator position relative to the board and thus the direction of travel.

The option of using the above mentioned two methods in combination, simultaneously, with a shifting of the riders' weight is also possible. While traveling in motion, a rider can shift their weight principally to either foot and simultaneously shuffle and/or pivot their feet thus also changing their direction of travel or just change their body and feet positions relative to the board. This enables movements and maneuvers that can not be executed with conventional prior art sportingboards and bindings.

The present invention thus in general offers a further degree or degrees of freedom in movement of a rider's body during sportingboard events. Further, a rider thus enabled to change shooting positions while traveling can more easily and skillfully operate a sporting board when performing extremely difficult maneuvers. An example of this is the ability of a rider to become airborne in a half pipe (or similar situation) by launching in a goofy position and then flipping or spinning and then landing in a regular position. Riders can also kick or shuffle their feet back and forth rapidly while flipped upside down in somersault maneuvers in a sort of counting method that exhibits their skill during a jump.

Sudden down hill/straight line changes are also possible at high speed when a rider encounters a small jump. A rider can pivot their torso slightly, immediately after becoming airborne, while simultaneously and rapidly shuffling their feet from the initial shooting position to the alternate shooting position. Riders can execute quick pivoting "snap turns" while traveling at relatively slow speeds by shifting all, or almost all of their weight, onto one foot and then "kicking" the free/light end of the board in a new direction. Riders can execute this maneuver in a repetitive fashion and thus "walk" with the sportingboard attached to their feet. Also, while traveling, riders can shift their weight, shuffle their feet, and make sweeping turns while dynamically changing from the goofy to the regular shooting positions, or vise versa. Other maneuvers, trick moves or stunts can be performed dynamically while "on the go" that can't be otherwise performed on a regular sportingboard (a.k.a. "board" or "boards") with conventional bindings.

Description and Operation—Drawing Figures

Figure 1:
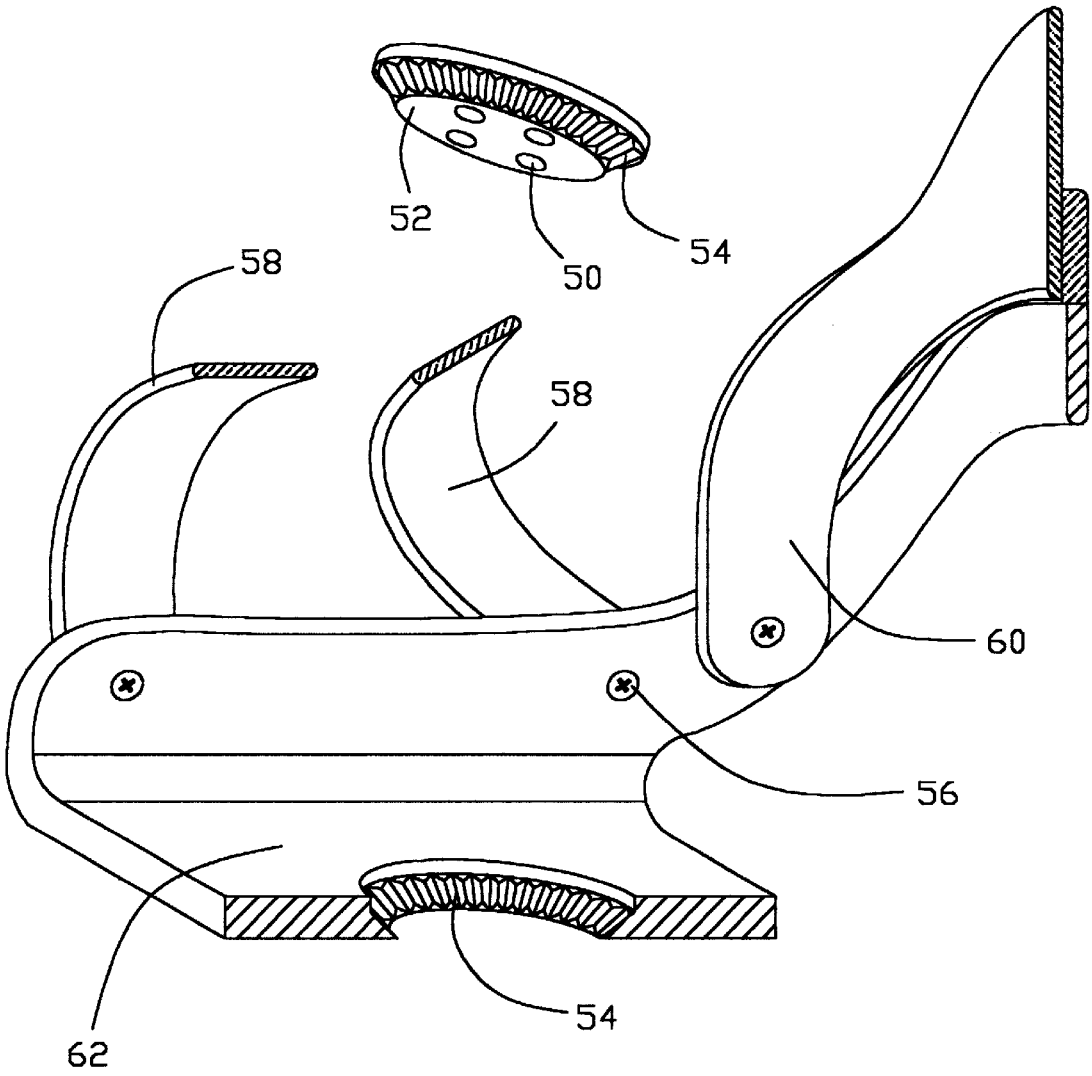
FIG. 1 PRIOR ART
FIG. 1 is an oblique perspective, sectional view of a typical PRIOR ART non-dynamic boot bracket of the locking disc type.

Description and Operation—FIG. 1

Description FIG. 1

Shown in FIG. 1 is a typical PRIOR ART boot bracket of the locking disc type. A disc type fixed boot bracket 64, is shown having two boot straps 58 attached by fasteners 56. At the rear of boot bracket 62 an upper portion of the bracket engages and supports a leg support 60. Leg support 60 is attached to boot bracket 62 by fasteners 56. A locking retainer disc 52 having fastener holes 50 is shown suspended above boot bracket 62 for illustrative purposes. Both disc 52 and boot bracket 62 have locking teeth 54.

Operation FIG. 1

Disc type fixed boot bracket 62 is retained and locked from rotation by locking retainer disc 52, via the meshing of locking teeth 54. Locking retainer disc 52 is attached to a sportingboard by fasteners through fastener holes 50. Rotational adjustment of the binding is made by loosening and raising/disengaging the locking disc 52 and rotating disc boot bracket 62. When adjusted to a desired position locking disc 52 is then refastened to the board, thereby locking disc boot bracket 62. Leg support 60 provides support for the rider. Boot straps 58 provide retention means for the rider's boot.

Figure 2:
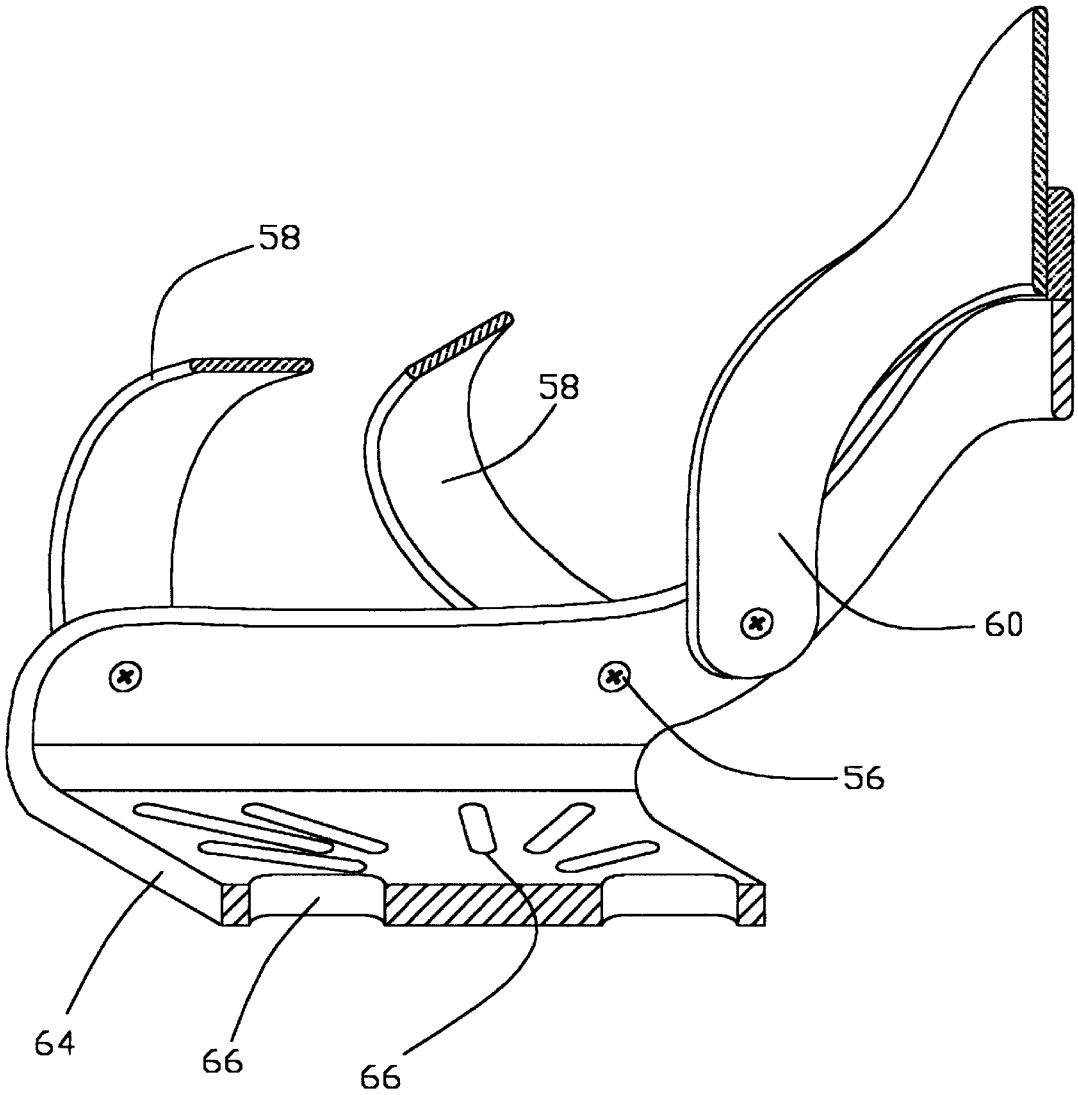
FIG. 2 PRIOR ART
FIG. 2 is an oblique perspective, sectional view of a typical PRIOR ART non-dynamic boot bracket of the direct mount locking type with fastener slots.

Description and Operation—FIG. 2

Description FIG. 2

Shown in FIG. 2 is a PRIOR ART sporting board binding of the fixed type. A slotted type fixed boot bracket 64 is shown having slots 66 in FIG. 2. Boot straps 58 are shown attached by fasteners 56, which retain snowboard or similar boots. A leg support 60 is shown also attached to slotted boot bracket 64.

Operation—FIG. 2

Adjustment is made for the assembly shown in FIG. 2 by removing fasteners from slots 66 and rotating slotted boot bracket 64 essentially about the center of a fastener hole pattern in the sportingboard. Different clusters or groups of fastener holes in the board provide for different foot stance positions.

Figure 3A:
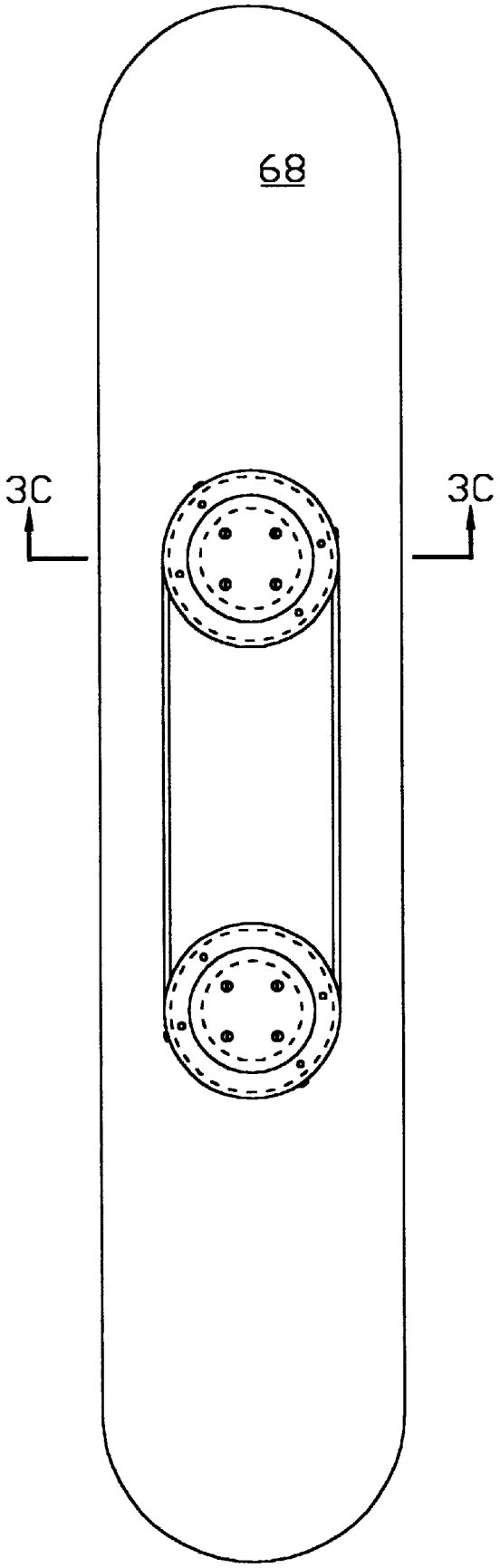
FIGS. 3A, 3B & 3C are views of the present invention having a belt type rotary transmission means.
Figure 3B:
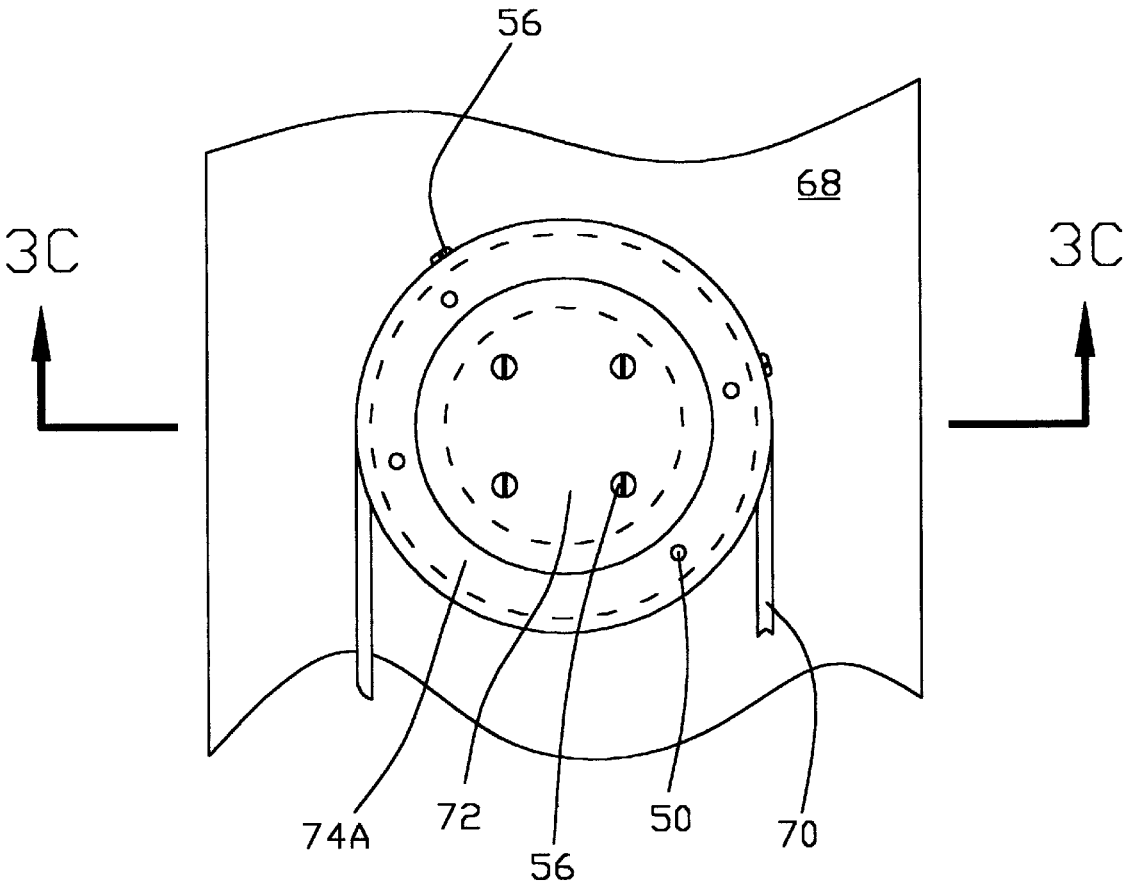
Figure 3C:
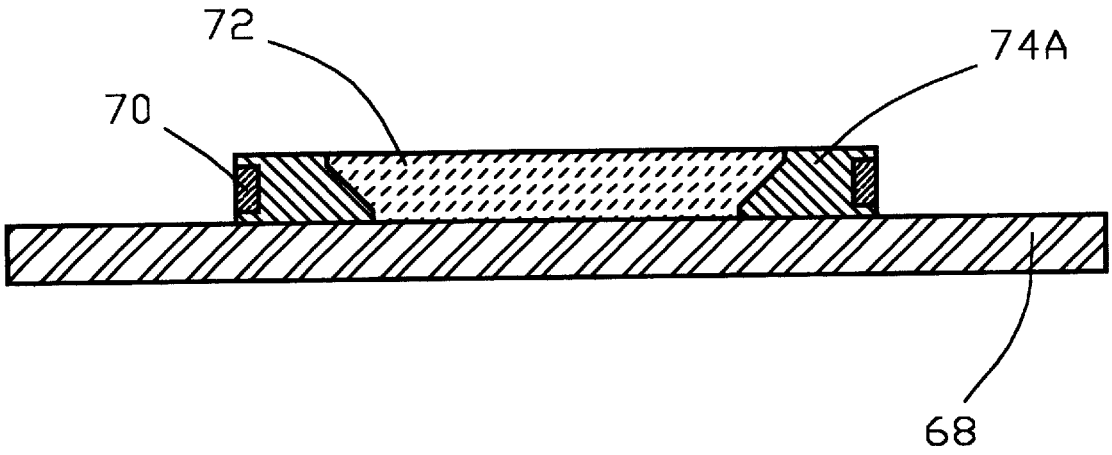

Description and Operation—FIGS. 3A, 3B & 3C

Description FIGS. 3A, 3B & 3C

FIG. 3A is an overall top view of one embodiment of the present invention having a belt or band type drive system. FIG. 3B is a partial top view of one of the foot/boot bracket mounting areas of the same embodiment shown in more detail. Both FIGS. 3A & 3B indicate sectional view 3C of the same embodiment. FIG. 3A shows an overall view revealing the general orientation of basic members as they relate to one another and only sportingboard 68 is labeled in FIG. 3A.

In FIG. 3B a closer view shows a drive belt 70 which connects both pivot mount plates-belt drive 74A. Drive belt 70 is shown attached to pivot mount plate 74A by two fasteners 56. Drive belt 70 is (or is made of materials similar to) any of the lightweight flexible belts used in power transmission drives that are readily available. Drive belt 70 can also be a lightweight chain or thin steel band or similar flexible-driving element. Different lengths of drive belt 70 can achieve different foot width stances for various rider preferences. This is accommodated in cooperation with different bolt patterns in sportingboard 68, for retainer disc 72. This is commonly done in the prior art but is not illustrated in FIG. 3. An alternate driving means employing a pusher chain is also possible.

In FIG. 3B Fastener holes 50 are shown in pivot mount plate 74A to receive a boot mount bracket of the various kinds commonly found in use. Pivot mount plate 74A can also receive a step in type binding plate (companion) lower portion via attachment with fasteners. Pivot mount plate 74A, as an integral part of a (modified) step in type binding system, can also itself be the plate portion of a mated boot binding system that mates with a boot. Fasteners 56 hold retainer disc 72 to a sporting board. Pivot mount plate 74A can also have a boot bracket as an integral component. This isn't illustrated in FIG. 3 but is illustrated in FIG. 13. Retainer disc 72 can be recessed below the surface of pivot mount plate 74A and/or have a protective shield (not illustrated) which is most likely attached to pivot mount plate 74. Pivot mount plate 74A can also have a foot bracket (to receive a rider's foot directly) as an integral component, this is shown in FIG. 12. Sportingboard 68 can have standard fastener hole patterns typical to the prior art or a unique pattern. Retainer disc 72 locates and retains pivot mount plate 74A, but allows free rotation, since it has no locking teeth. This is true for essentially all of the embodiments of the present invention.

FIG. 3C shows drive belt 70 engaged in a groove that is part of pivot mount plate-belt drive 74A. Retainer disc 72 is attached to sportingboard 68; no fasteners are shown in this view. No significant gap is illustrated between retainer disc 72 and pivot mount plate 74A, or between sportingboard 68 and pivot mount plate 74A. Some clearance between these members is necessary to allow free rotation of pivot mount plate 74A. No lubricants are indicated in FIG. 3 but may in some embodiments be desirable. No seals are shown at the interface "gap regions" mentioned but may in some embodiments be used to seal out contaminants or moisture, and/or to isolate/retain wet or dry lubricants. Further no bearings or thin "shim type" load bearing materials are indicated but these types of elements can also be used in the gap regions between the dynamic and static members.

The materials of choice are chosen for lightweight, high impact resistance, low coefficients of friction (if components are dynamic in their relation) and good wear characteristics. Further the materials have to be compatible relative to the operational environment. Moisture is typically a problem in all environments except perhaps those of a sandboard. However sand is a problem for dynamically related components for a sand board and most probably not in others except perhaps a wakeboard. Tensile strength, creep, impact resistance, dimensional stability, etc.—these and more—and with regard to the temperature range of operation (and storage) are to be considered in each embodiment. Information is readily available for the materials listed above that are used in the respective arts of sportingboards, foot bindings, and drive systems.

For example nylon is reinforced with fibers to obtain greater strength, and is in use for foot bindings currently. Also having a good coefficient of friction is not extremely critical for the loads and the rotational velocities present but such things are to be considered. Teflon is an additive used in some resins to obtain better coefficients of friction; and different material types can be used to reduce these factors in mating components. An example of this would be using a nylon resin with an acetyl resin. These considerations are to be made for all the embodiments of the present invention, not just FIG. 3. Engineering information enabling one skilled in the art to design correctly for manufacture and use with specific materials is readily available in design literature from suppliers and engineering texts.

Operation—FIGS. 3A, 3B & 3C

Both pivot mount plates-belt drive 74A, shown in FIG. 3A, rotate in the same clockwise or counter-clockwise direction. Both of these members are constrained to do so by drive belt 70, which is attached by fasteners 56. Fasteners 56 prevent belt slippage and also can serve as a stop for the terminal position i.e.—the rider's goofy and/or regular foot positions of choice. Drive belt 70 maintains rotational timing between the rider's feet to prevent a foot "stance misalignment" which might cause injury to the rider and/or loss of control of the sportingboard. The rider of the sportingboard imparts torque with either or both feet; drive belt 70 carries any difference in torque between feet, thus maintaining rotational alignment. The (effective drive) diameters of both pivot mount plates-belt drive 74A are shown in FIG. 3A to be essentially equal. This establishes a one-to-one drive ratio. In some embodiments riders may want to vary the ratio of drive to be other than one-to-one for a variation in degrees of rotational travel between feet. In this embodiment changing the effective belt diameter will change this ratio. Installing split ring shims between the belt and the diameter of pivot mount plates 74A, thus increasing the effective belt diameter, can do this. However this feature is not shown in any of the views of FIG. 3.

Figure 4A:
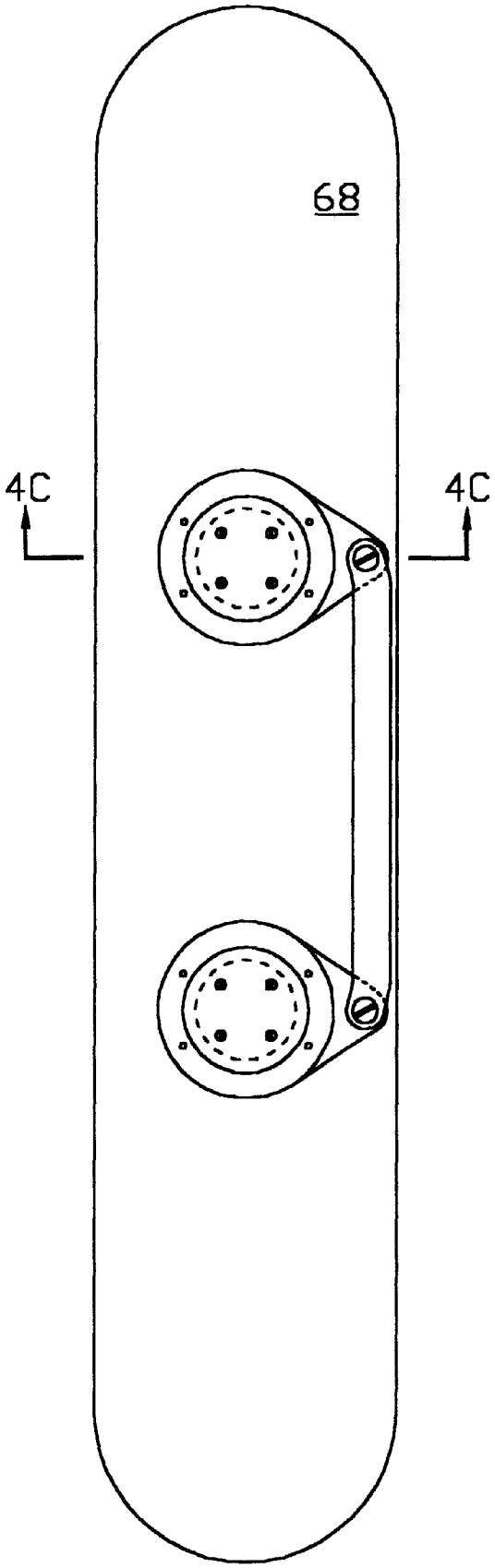
FIGS. 4A, 4B & 4C are views of the present invention having a connecting rod type rotary transmission means.
Figure 4B:
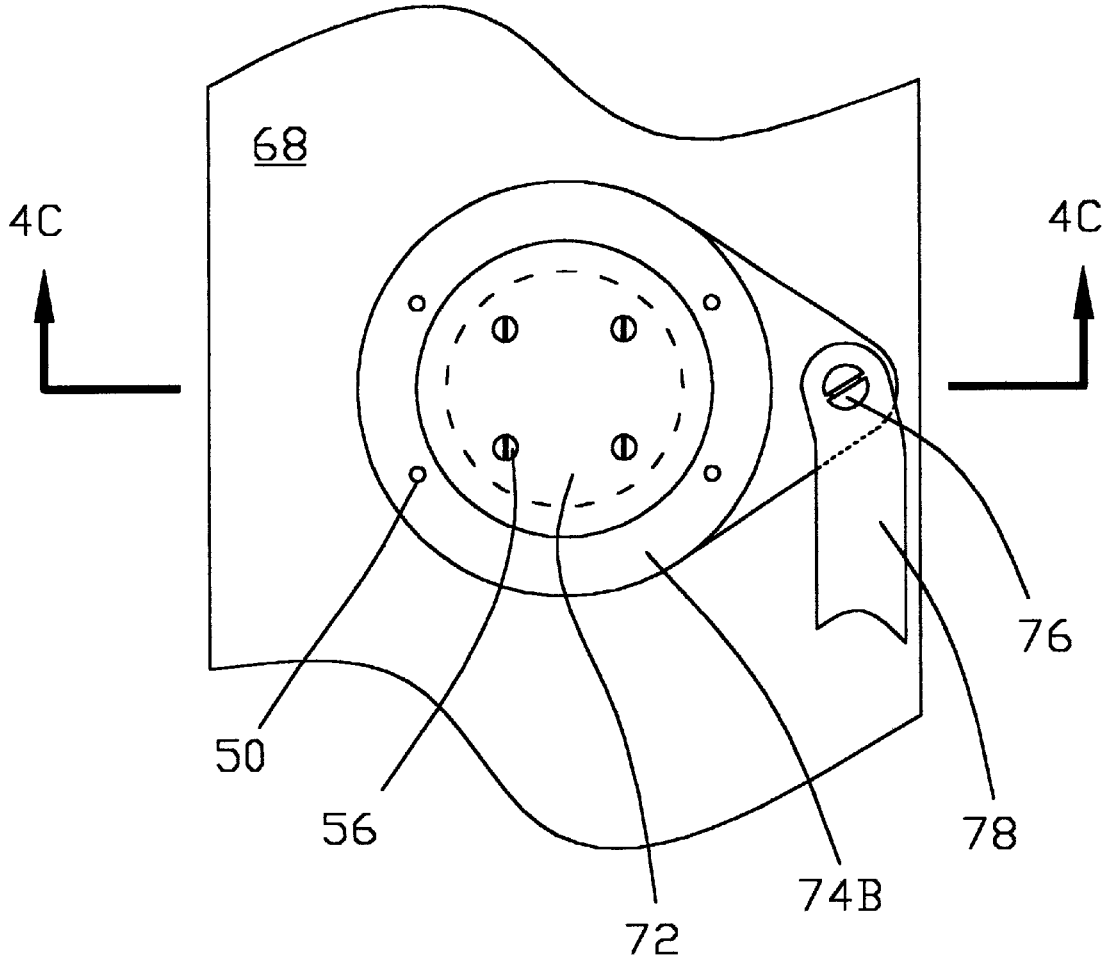
Figure 4C:
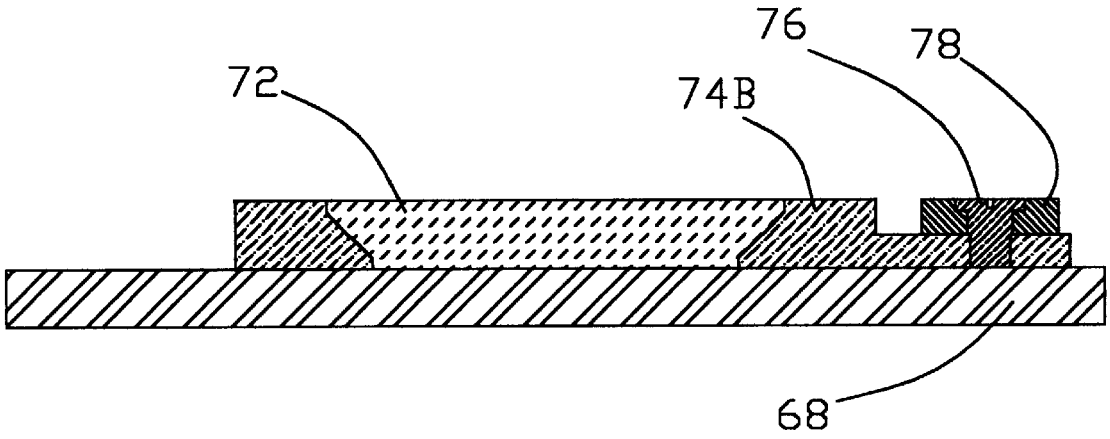

Description and Operation—FIGS. 4A, 4B & 4C

Description—FIGS. 4A, 4B & 4C

FIG. 4A is a top overall view of an embodiment of the present invention utilizng a connecting rod type drive system. FIG. 4B is a close-up view of one of the foot mounting positions. FIG. 4C is a sectional view as indicated. A sportingboard of the conventional type is shown in FIG. 4. The drive system shown in FIG. 4 has two pivot mount plates-rod driven 74B attached together by connecting rod 78. Large pivot pins 76 attach the ends of rod 78 to pivot mount plates 74B. Material for connecting rod 78 is to be lightweight and is able to sustain loading in both tension and compression and must be able to flex as sportingboards are subject to flexure during operation. For this reason a metal can be employed for rod 78 but one of the reinforced resins is probably a better material choice.

The large pivot pins 76 can be of metal or a high strength dimensionally stable reinforced resin. Large pivot pins 76 can be retained by either connecting rod 78 or pivot mount plate 74B, but must be free to rotate in at least one of the members at the connection point while maintaining connection of all three elements at both joints. Consideration is made for the materials of construction with regards to both friction and wear in the interrelation of connecting rod 78, pivot mount plates 74B, and pivot pins 76.

The radial distance of the location of pivot pin 76 from the axis of rotation namely the center of retainer disc 72 can be adjusted to accommodate a different drive ratio between a rider's feet. This can be accomplished by having a slot in pivot mount plate 74B, or having different discrete hole locations in pivot mount plate 74B and/or having an eccentric cam integral to pivot pin 76. Having different holes in connecting rod 78 also can do this also. Having different hole positions in connecting rod 78 also can accommodate different foot stance orientations as the centers of pivot mount plates 74B are changed.

Operation—FIGS. 4A, 4B & 4C

Riders using this embodiment maintain the cooperative relation of foot positions relative to each other via connecting rod 78. An imbalance in operator induced torque between a rider's feet is resisted by connecting rod 78, which maintains rotational alignment of pivot mount plates-rod driven 74B. No limiting stops are shown other than that which is intrinsic to this design by physical limitations. As connecting rod 78 translates it will eventually contact pivot mount plates 74B in interference to rotation, establishing the extreme limits of clockwise and counterclockwise rotation. The dimensions of pivot mount plates 74B and of connecting rod 78 thus influence the rotational limits of this drive system in conjunction with this intrinsic limiting constraint.

Figure 5A:
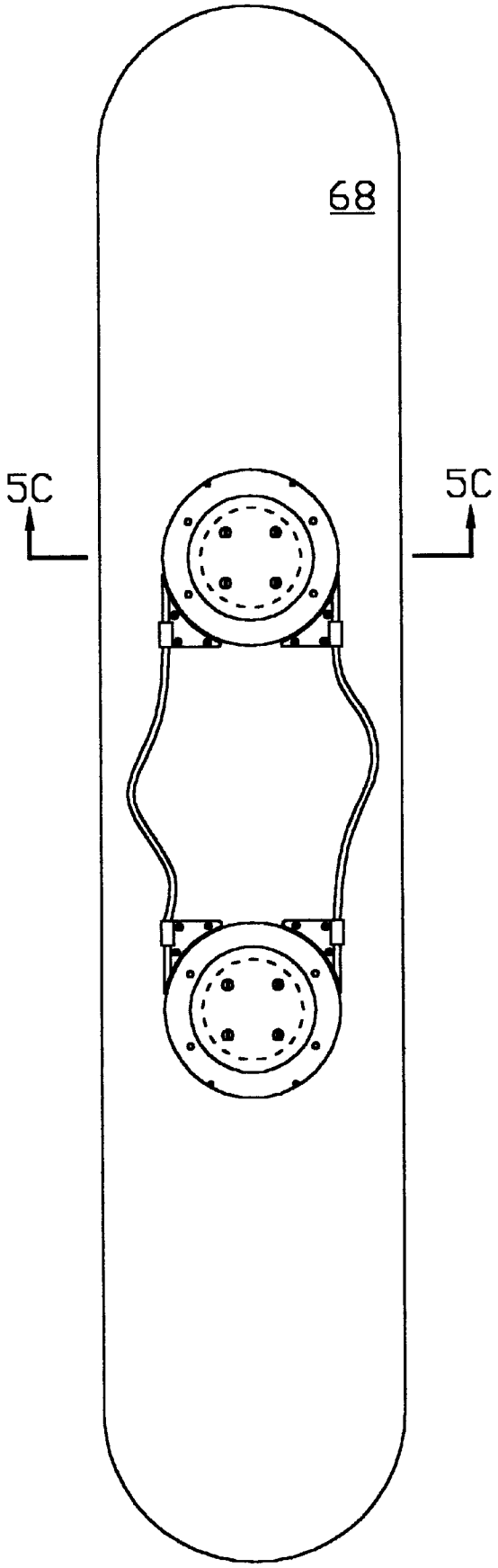
FIGS. 5A, 5B & 5C are views of the present invention having a sheathed cable type rotary transmission means.
Figure 5B:
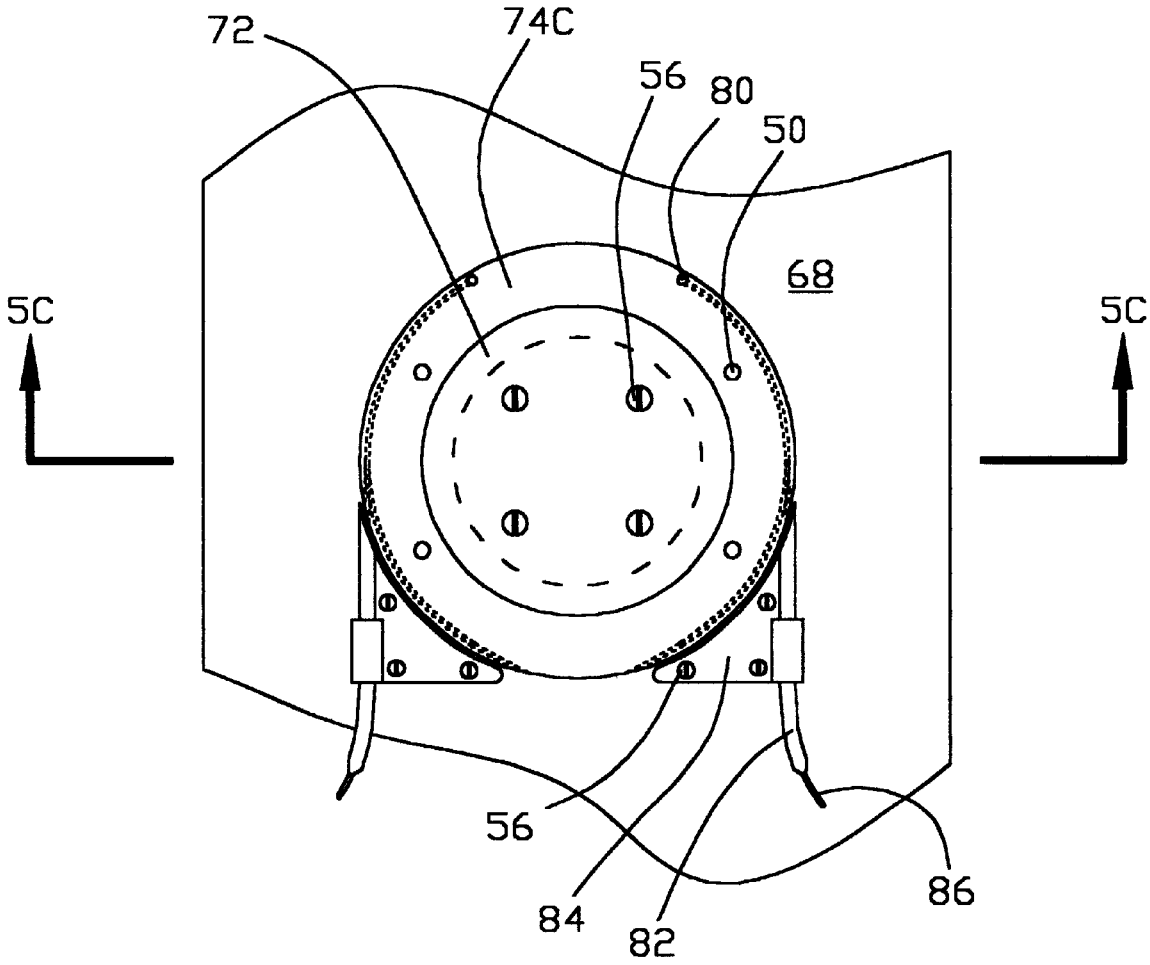
Figure 5C:
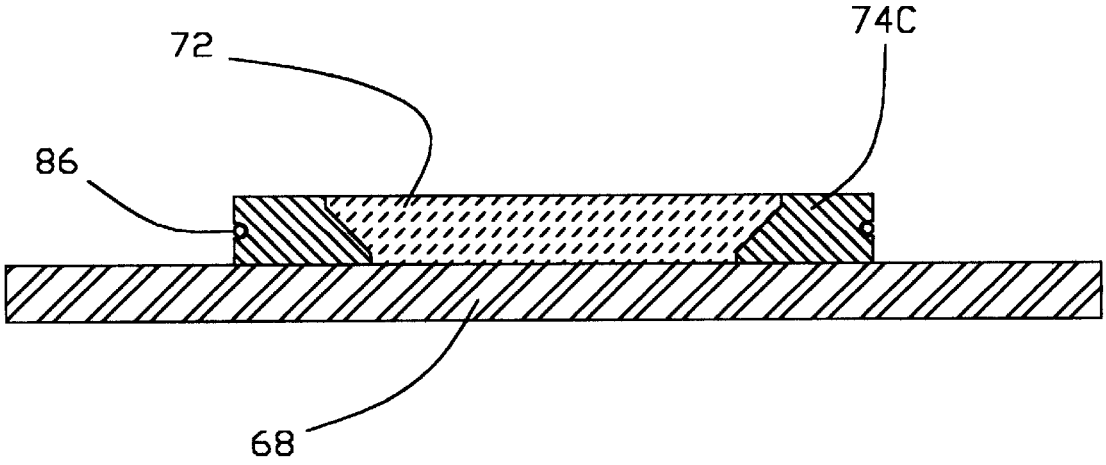

Description and Operation—FIGS. 5A, 5B & 5C

Description—FIGS. 5A, 5B & 5C

FIG. 5A shows an overall view of the present invention in an embodiment that employs a cable type drive system. Two cables 86 are housed in cable sheaths 82 which are employed as a means for maintaining the rotational alignment of pivot mount plates-cable driven 74C. Cable retainer ends 80 are held captive by pivot mount plates 74C and thus cables 86 are linked to pivot mount plates 74C. Cables 86 are retained in a groove in pivot mount plates 74C as can be seen in the sectional view of FIG. 5C. Cable housing brackets 84 attach cable sheaths 82 to sportingboard 68 via fasteners 56. This system as shown requires two cables that are employed as tensile loaded members to obtain proper rotational alignment of pivot mount plates 74C.

A single cable element, typically more robust, which is loaded in both compression and tension is possible. This requires containing the cable at all points of travel to prevent buckling or "kinking" the cable in the compressive mode. This is in some ways similar to a "push chain" embodiment. These features are not illustrated but are clearly a viable embodiment of the present invention. The cables illustrated and employed in the embodiment shown in FIG. 5 are of the lightweight kind similar to those employed in bicycle designs. The adverse conditions, regarding moisture especially, probably dictate that a stainless cable with a sealed, internally lined cable housing be used.

This system is lightweight, flexible, and lends itself to adjustment of varying foot stance positions well. This embodiment lends itself well to a "bolt on" applications, which employ existing sportingboards essentially as found in the prior art. No guard or enclosure is shown which fully encloses the components for illustrative purposes, however a design integrating cable housing brackets as components of a drive housing or guard (or guards) is a preferred embodiment. For safety purposes spring-loaded radial locking pins based in pivot mount plates 74C which would engage stops in a drive housing or guard—if either cable were to break—is a desirable feature. This can be done in many different ways but it would require that at least one such radial locking pin be employed for each cable 86. These spring-loaded locking pins would be retained by the cable in tension, and would engage the inside of the guard or housing only if a catastrophic cable failure occurred.

Operation—FIGS. 5A, 5B & 5C

Two oppositely acting cables 86 remain in a balanced tension when attached at (their terminal) cable ends 80 to pivot mount plates-cable driven 74C. Cables 86 thus resist any difference in the torque between a rider's feet, causing a rider's feet to rotate in unison.

Figure 6A:
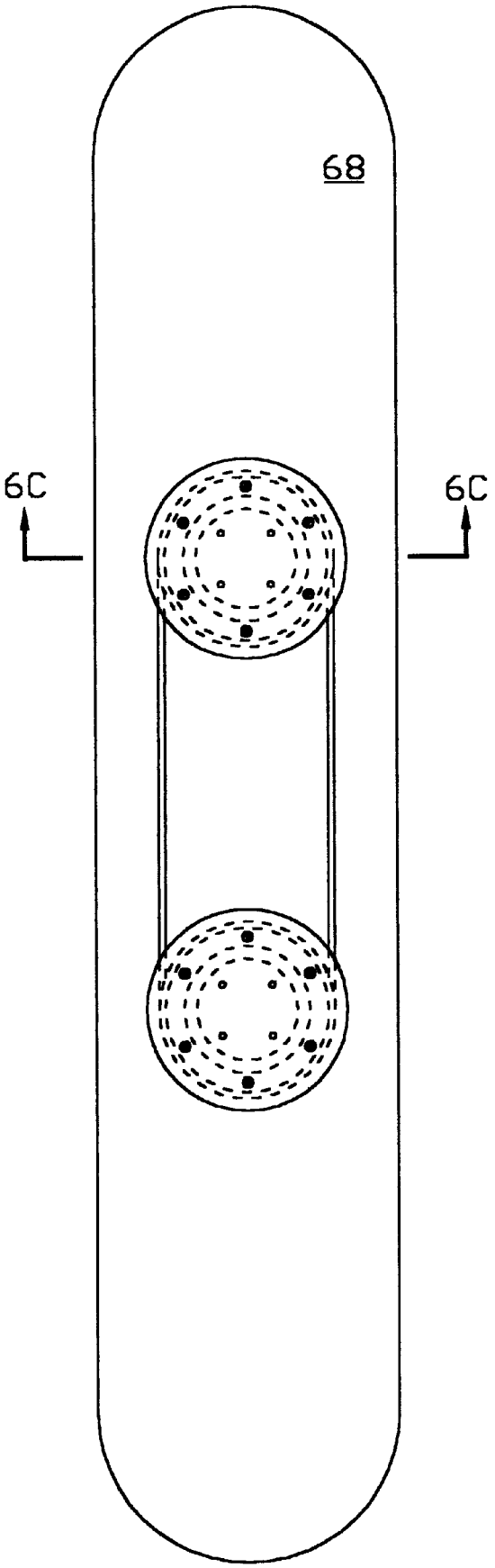
FIGS. 6A, 6B & 6C are views of the present invention having a belt type rotary transmission means and a two piece pivot mount plate.
Figure 6B:
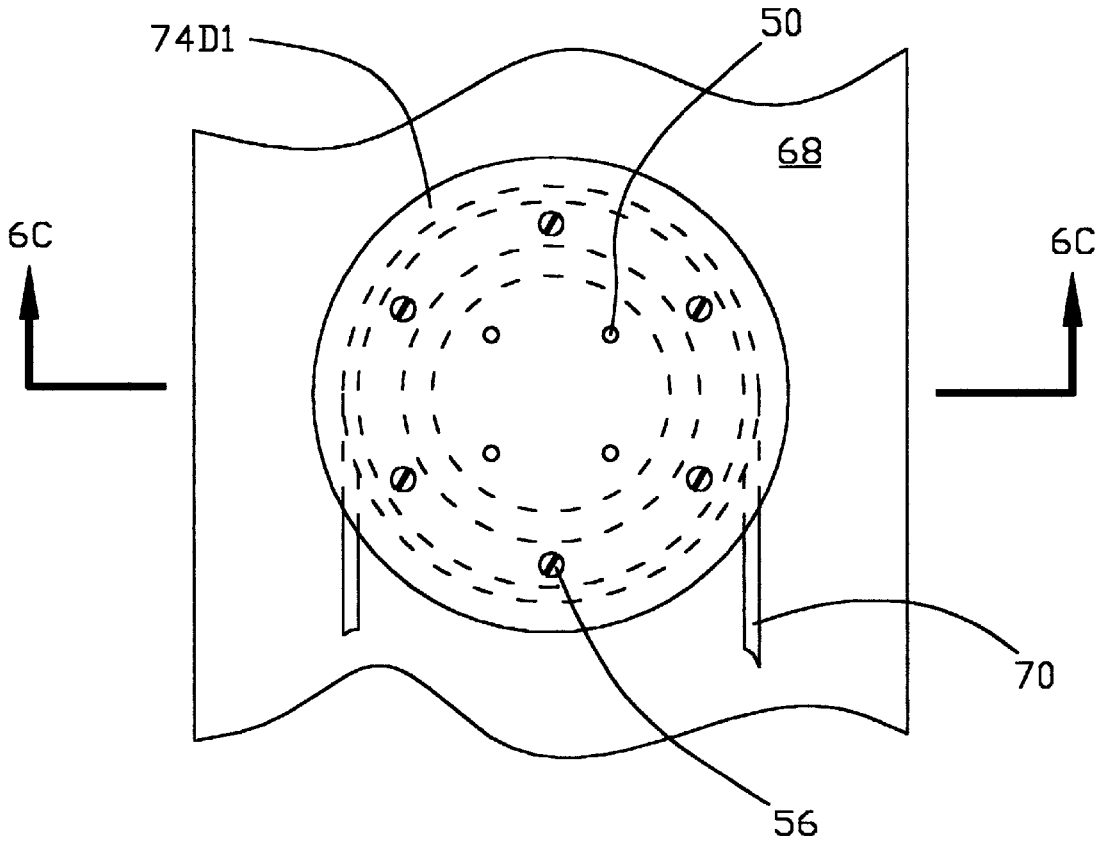
Figure 6C:
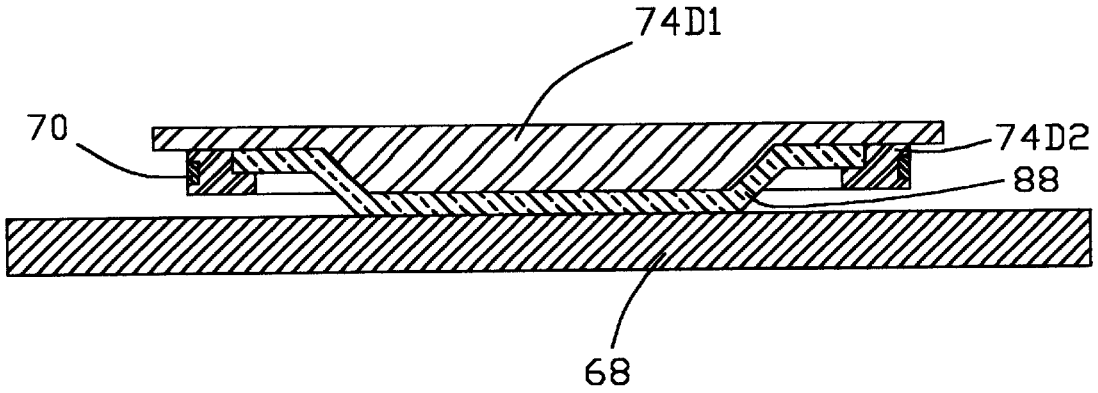

Description and Operation—FIGS. 6A, 6B & 6C

The embodiment of FIG. 6 is a design similar to that shown in FIG. 3 in that both drive systems employ a belt, chain, or driving band of some kind. FIG. 6C illustrates a two-part rotating foot pivot mount plate system in a sectional view. A pivot mount plate-two piece-upper portion 74D1 is attached to and operates in unison with pivot mount plate-two piece-lower portion 74D2 via fasteners (not shown in FIG. 6). Pivot mount plate lower 74D2 has a groove for drive belt 70. Support flange 88 is attached to sportingboard 68 via fasteners (not shown in FIG. 6) and does not rotate. The pivot mount plate pair 74D sandwiches support flange 88 and rotates on and around flange 88. Support flange 88 is a critical component and may be manufactured out of an aluminum alloy or a high strength reinforced resin. As can be seen in FIG. 6C, pivot mount plate upper 74D1 extends beyond pivot mount plate lower 74D2 some amount. Thus pivot mount plate upper 74D1 acts as a guard when a chain type drive is used, similar to those used adjacent to bicycle sprockets.

Figure 7:
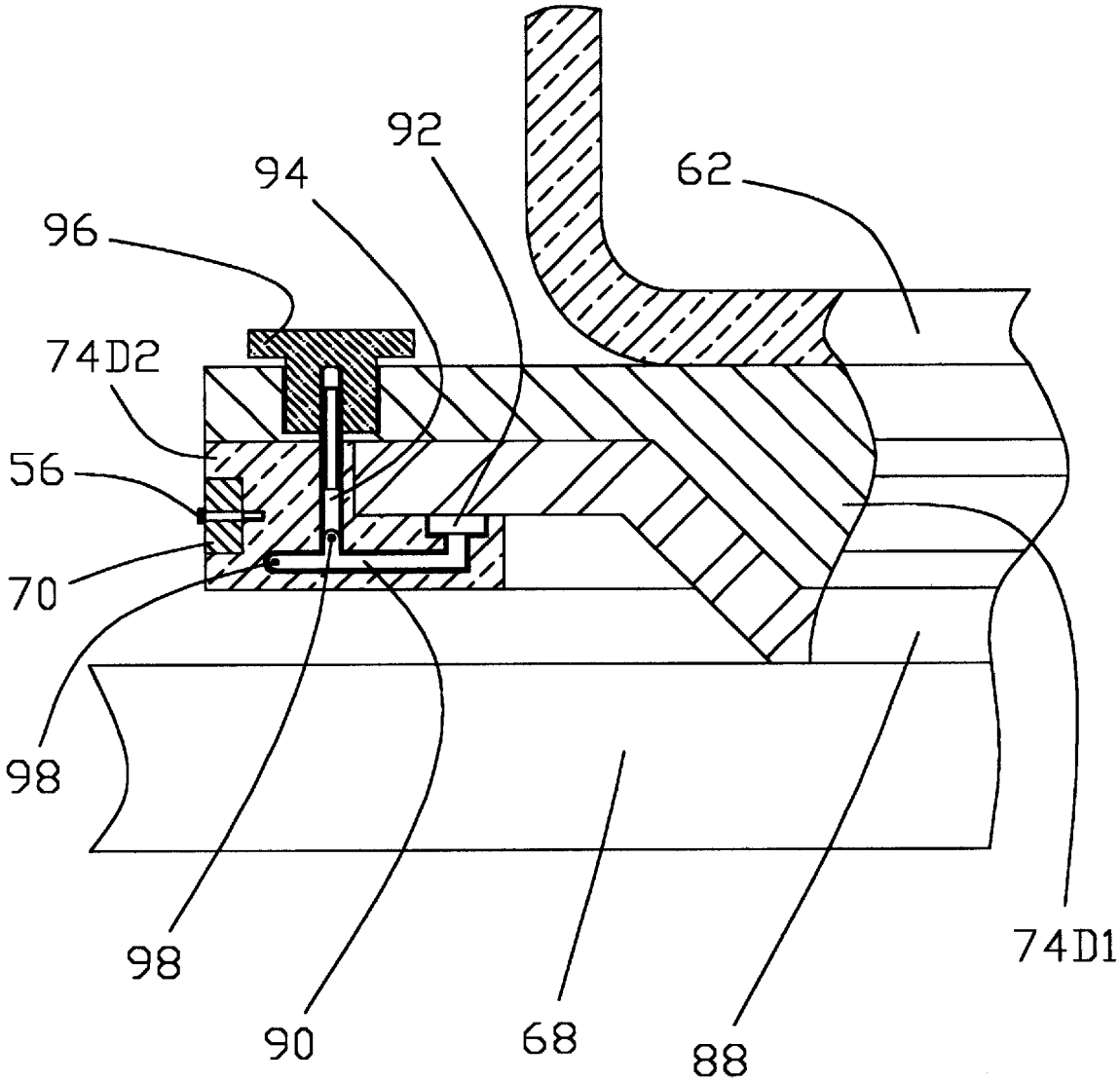
FIG. 7 is a partial, broken, side view of the present invention including a braking or friction control device with an adjuster nut or handle.

Description and Operation—FIG. 7

Description—FIG. 7

Shown in FIG. 7 in a partial broken sectional side view is a belt type drive system attached to a sporting board of the present invention which includes a brake or rotational friction control device. The general design of this embodiment is similar to that of FIG. 6, but includes certain modifications. A removable boot bracket 62 is attached to pivot mount plate-two piece-upper portion 74D1. Adjuster nut-handle 96 is shown in a counter-bored hole in pivot mount plate upper 74D1, which is free to spin about and act on pull rod 94. Pull rod 94 is attached to lever arm 90 by small pivot pin 98. Lever arm 90 is attached to pivot mount plate-two piece-lower portion 74D2 (which has a cavity and modifications to accept shown parts) by another pivot pin 98. A brake pad 92 is attached to or is an integral part of arm 90 and acts upon support flange 88. A fastener 56 locks drive belt 70 to pivot mount plate lower 74D2 and is able to act as a rotational limit or stop. Drive belt 70 and pivot mount plate lower 74D2 may have many perforations/fastener holes to allow many incremental stop positions to be possible, however this is not shown in FIG. 7.

Operation—FIG. 7

A rider adjusts the rotational resistance of both feet relative to sportingboard 68 by turning adjuster nut-handle 96. Nut-handle 96 maybe turned either directly by hand or indirectly by a tool depending upon the geometry of nut-handle 96. Nut-handle 96 pulls (or releases) rod 94 which causes arm 90 to pivot and thus move pad 92 toward (or away) from flange 88. Adjustment of adjuster nut-handle 96 can cause enough resistance to essentially "lock" the pivot mount plates 74D from moving, or be adjusted to rotate free, unhindered.

Figure 8:
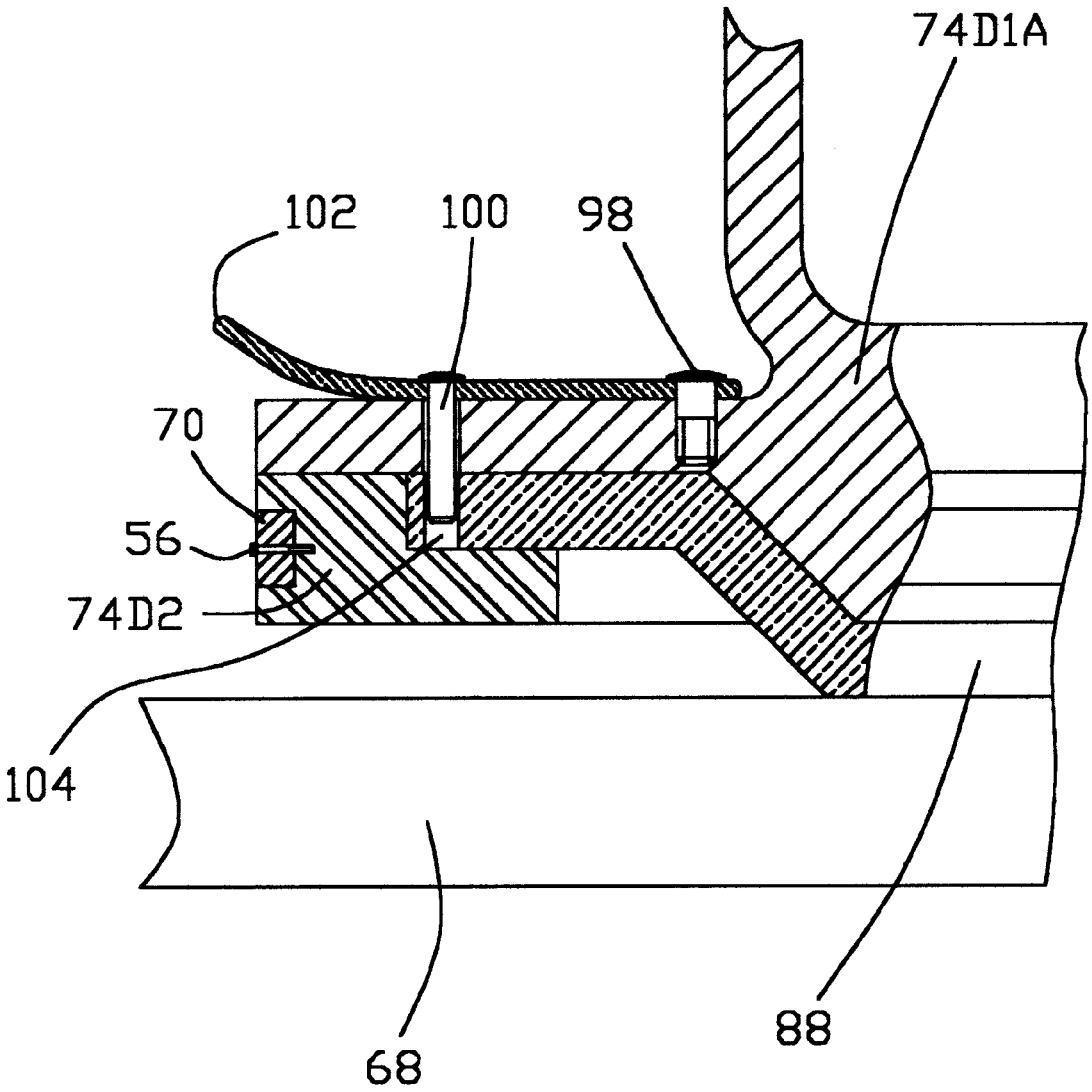
FIG. 8 is a partial, broken, side view of the present invention including a rotational locking device.

Description and Operation—FIG. 8

The embodiment in FIG. 8 is similar to FIG. 7 with two exceptions.

A locking device is shown.

A boot bracket is shown as an integral component of a pivot mount plate.

Thus pivot mount plate-two piece-upper portion-with integral boot bracket 74D1A has an integral boot bracket as well as a locking device. Spring tab 102 is attached to a shear pin 100 and these two parts act in unison. Both tab 102 and pin 100 are attached to pivot mount plate upper 74D1A by a small pivot pin 98. Pivot pin 98 holds tab 102 but allows free rotation of tab 102 about pivot pin 98's principal axis. Support flange 88 has at least one shear pin hole 104 to receive shear pin 100 but preferably many holes in a circular pattern about, and essentially equidistant from, the rotational axis of pivot mount plate 74D1A. Pivot mount plate 74D1A has a hole to receive and allow shear pin 100 to move in conjunction with tab 102.

Pivot mount plate 74D1A preferably has a radial slot for pin 100 to travel in which links the hole seen in FIG. 8 with a companion blind hole thus providing a "parked position" for pin 100. Thus pin 100 doesn't need to be lifted completely free of the hole in pivot mount plate upper 74D1A seen in FIG. 8. Adjustment is made by lifting up on the free end of tab 102 and either "parking" it in a receiving blind hole or holding the tab up while rotating the rider's feet to either an alternate locked position (another hole in flange 88). When parked in a blind hole that doesn't pass through pivot mount plate upper 74D1A, the rider's feet are free to rotate the foot mounting system (pivot mount plates 74D1A).

Figure 9A:
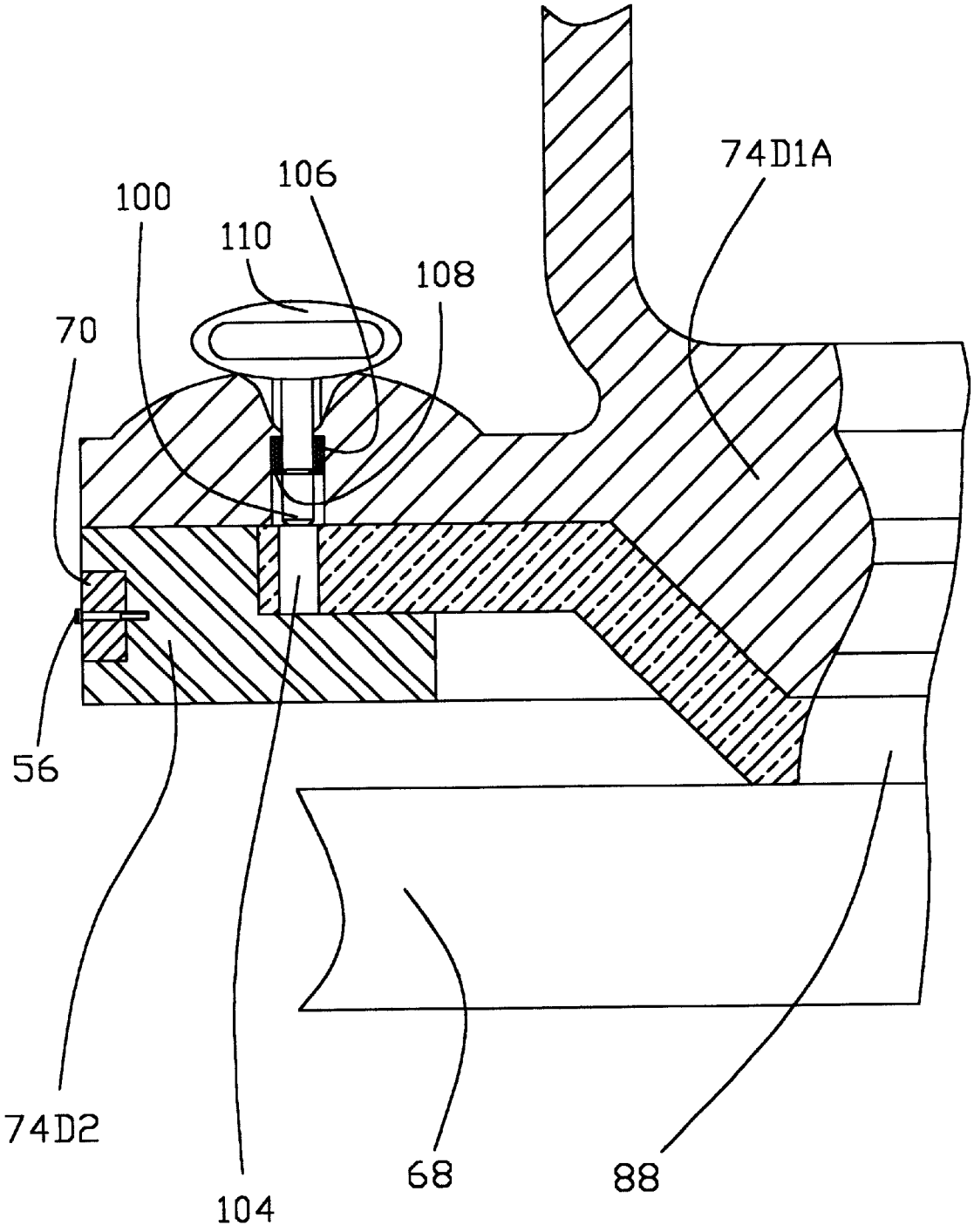
FIGS. 9A & 9B are partial, broken, side views of the present invention including a twist handle rotational locking device.
Figure 9B:
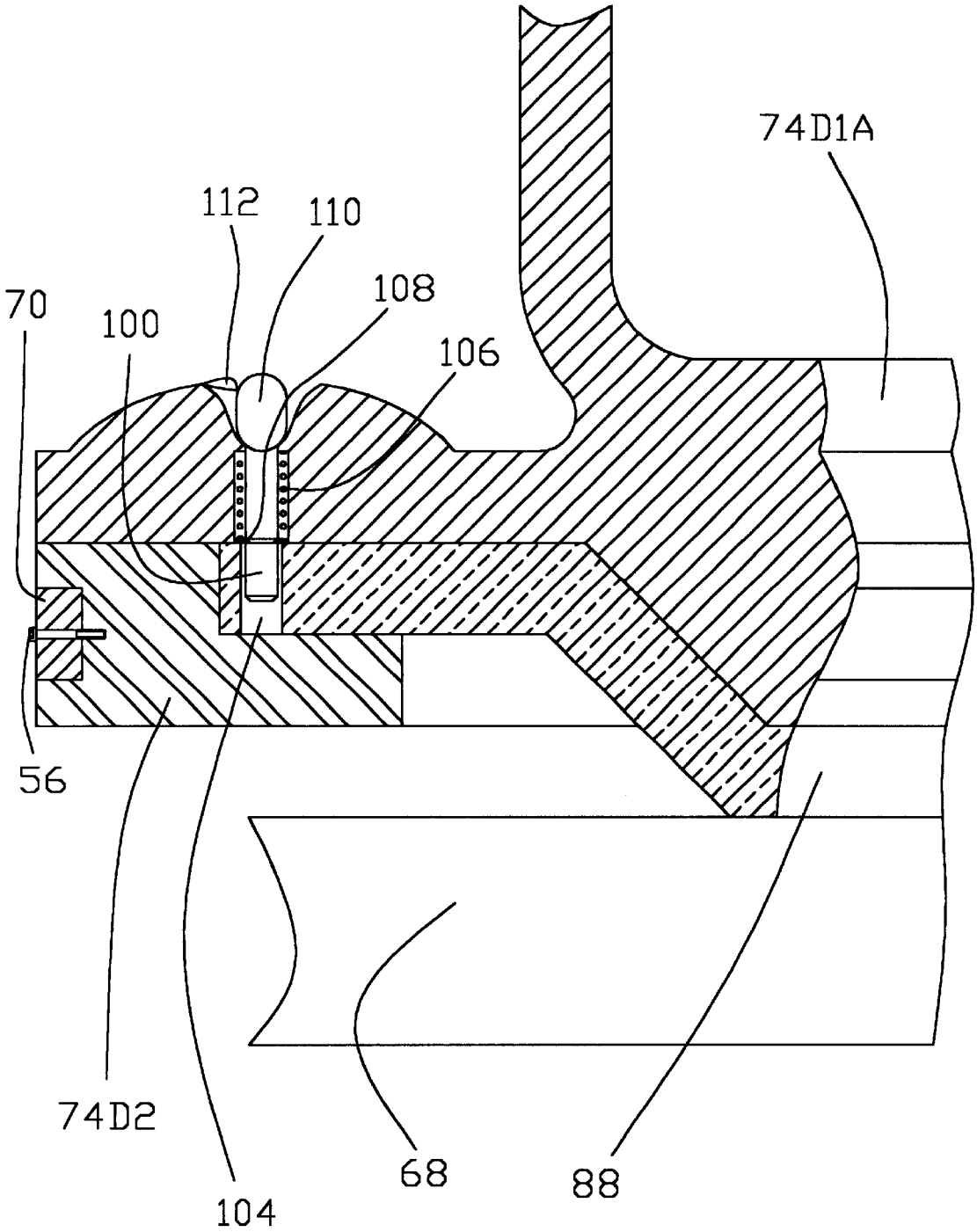

Description and Operation—FIGS. 9A & 9B

FIGS. 9A & 9B show the same embodiment but in two different operational modes. The embodiment shown in FIG. 9 is similar to the embodiment shown in FIG. 8 in that both of the embodiments employ locking mechanisms. The mechanism in FIG. 9 has a twist handle 110 and a coil spring 106, which is retained by spring retainer clip 108, to actuate shear pin 100. Pivot mount plate-two piece-upper portion-with integral boot bracket 74D1A thus is modified in FIGS. 9A & 9B to accommodate twist handle 110 and coil spring 106. The view of FIG. 9A shows a system mode that allows free rotation of pivot mount plates 74D, as shear pin 100 is locked in an upward position.

FIG. 9B shows the same shear pin 100 in an engaged position and is thus inside shear pin hole 104, preventing free rotation of pivot mount plate upper 74D1A. Handle 110 is rotated essentially 90 degrees in FIG. 9B from FIG. 9A. A twist handle stop 112 is seen in FIG. 9B that is hidden from view in FIG. 9A. This provides a position in the upper (disengaged) mode for handle 110 to rest in. This operates in concert with a "saddle" formed in pivot mount plate upper 74D1A for handle 110 to rest in. This is formed in conjunction with a helical profile that works to oppose spring 106, and retract pin 100, when handle 110 is rotated 90 degrees. Such a helical profie is not essential to the operation of this embodiment; it does require less effort of the operator though.

Figure 10:
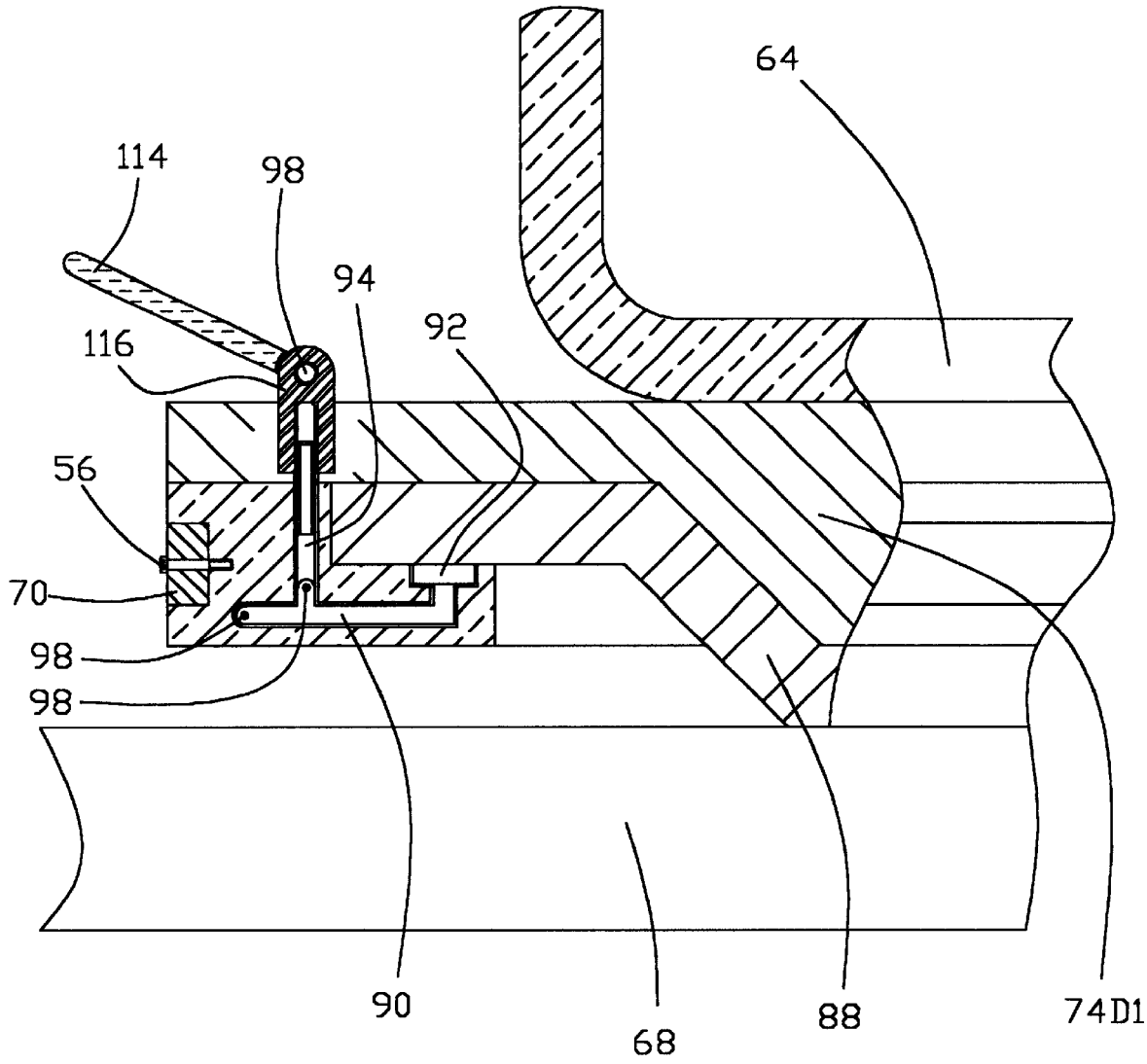
FIG. 10 is a partial, broken side view of the present invention including a braking or friction control device with a flip handle adjuster.

Description and Operation—FIG. 10

The embodiment shown in FIG. 10 is much like that of FIG. 8 in that both embodiments utilize a braking device. The principal difference is the type of handle mechanism used to actuate pull rod 94. Instead of using adjuster nut-handle 96 (shown in FIG. 7), a flip handle nut 116, small pivot pin 98, and flip handle 114 are used. Flipping handle 114 and/or rotating nut 116 makes adjustment possible for the embodiment in FIG. 10. A principal advantage of using a flip handle, besides being low in profile, is the possibility of a two stage adjustment means. If handle 114 has an eccentric cam (not seen in the view of FIG. 10) that is able to engage the top planar surface of pivot mount plate-two piece-upper portion 74D1, then two stages of adjustment are possible. Rotating the handle about the principal axis of pull rod 94 can be used for braking adjustment, and flipping the handle 114 approximately 180 degrees can impose further force thus "locking" pivot mount plate upper 74D1 from rotation. Alternately a rider can have a braking adjustment stage and a free (feet) rotational stage by flipping handle 114.

Description and Operation—FIGS. 11A, 11B, 11C, & 11D

The embodiment shown in FIG. 11 is that of the present invention having an enclosed type adjustable foot binding mechanism. In FIG. 11A a top overall view of a sportingboard of the present invention is shown having two principal enclosures, guards or housing sections—major guard enclosure 118 and minor guard enclosure 120. FIG. 11B shows a closer view of one of the foot mount areas seen in FIG. 11A, indicating sectional views of FIG. 11C & FIG. 11D.

Figure 11A:
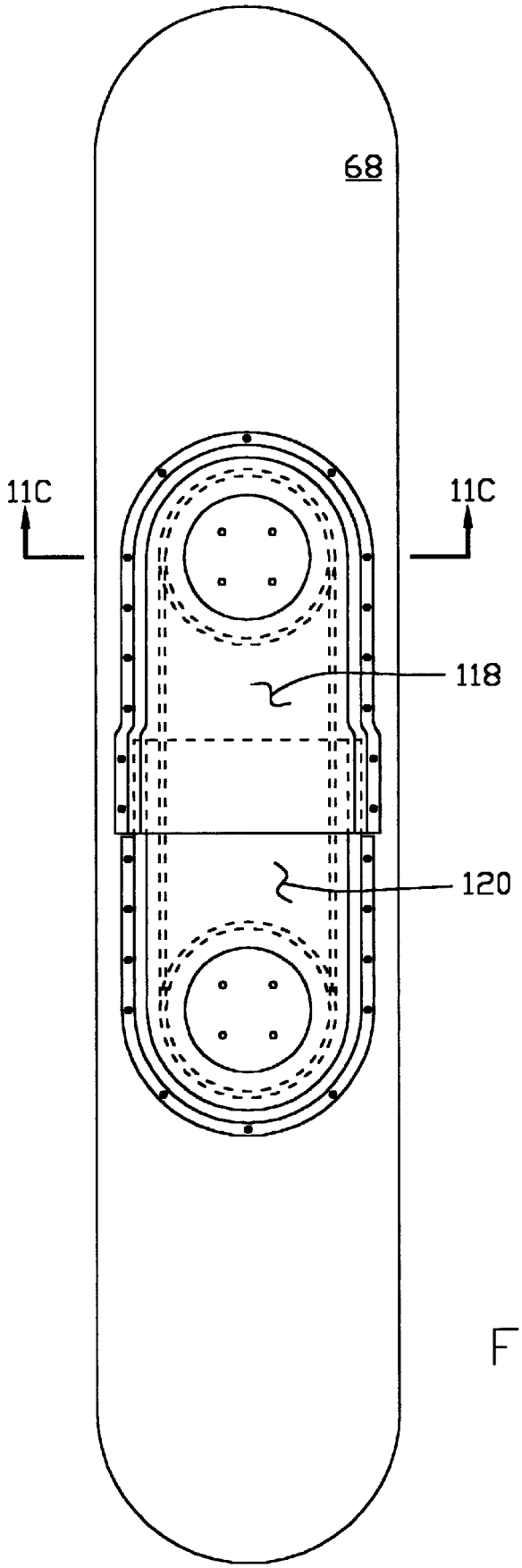
Figure 11B:
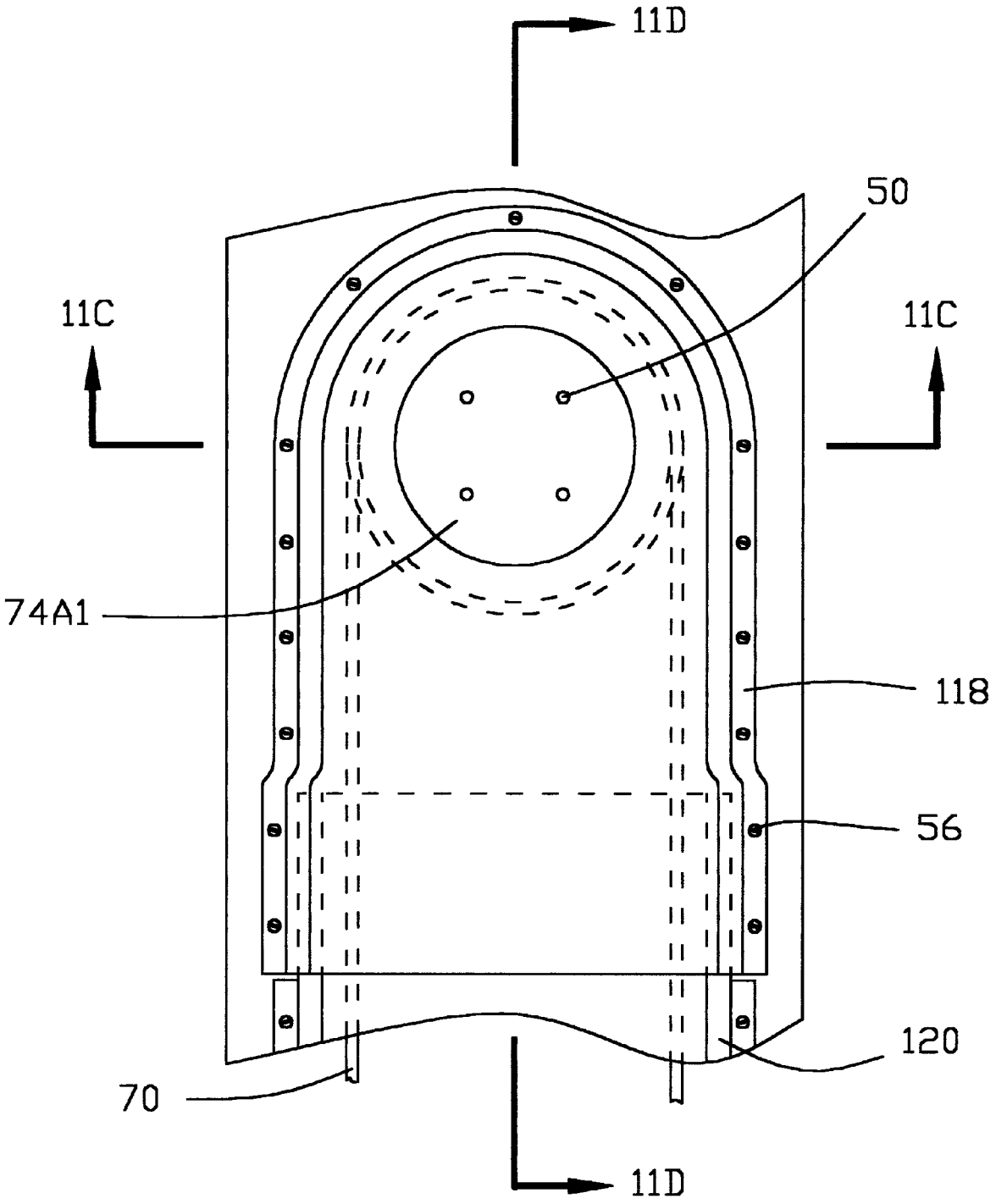
Figure 11C:
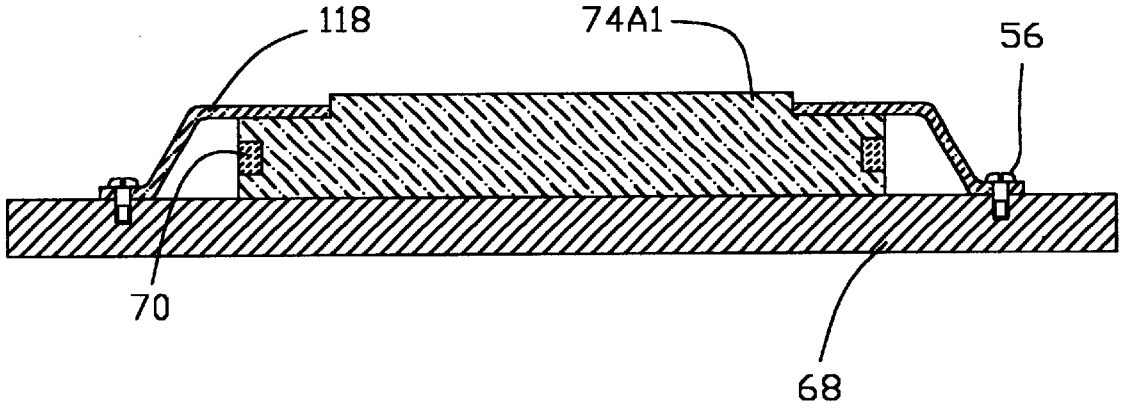
Figure 11D:
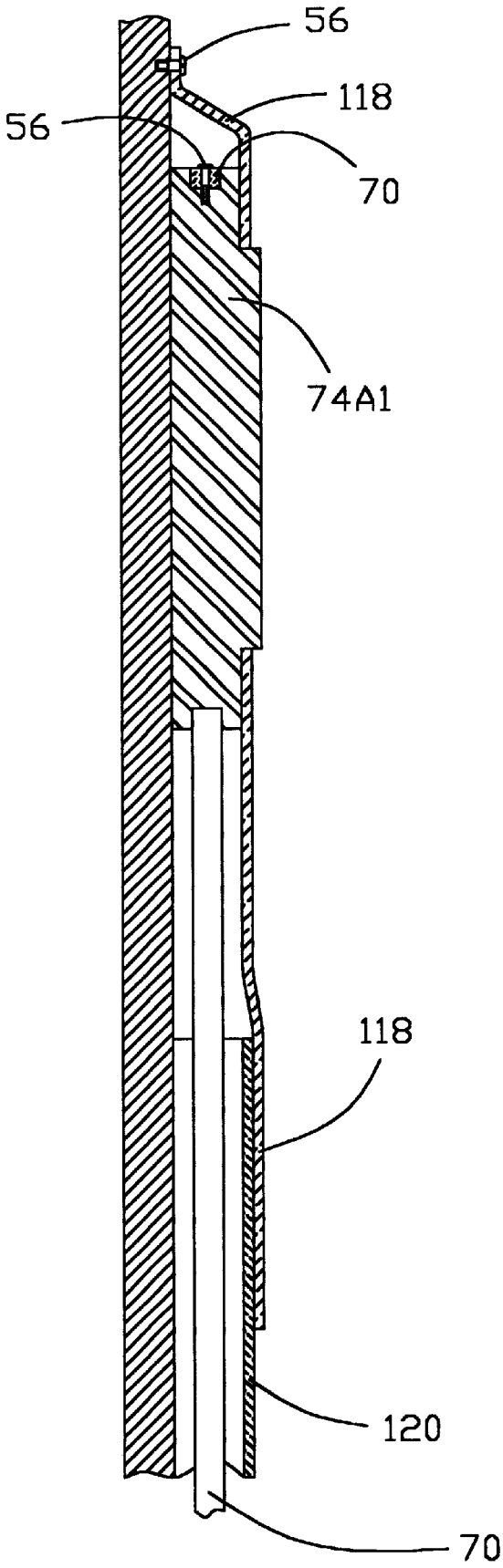

Major guard enclosure 118 is shown attached to a sportingboard 68 (not labeled in FIG. 11B but labeled in FIG. 11A), as is guard enclosure 120 by fasteners 56. FIG. 11B shows this in a partial sectional side view. Major enclosure 118 is enlarged to receive minor enclosure 120, which is shown inserted into major enclosure 118. FIG. 11D shows this in a partial sectional side view. This feature allows the adjustment of the center-to-center positions of pivot mount plate-belt drive-enclosed 74A1, and consequently the distance that the rider's feet are apart. Drive belt 70 is shown as a means for rotational transmission between enclosed pivot mount plates 74A1. Enclosed pivot mount plates 74A1 are shown as having fastener holes 50 to receive a "bolt on" type foot or boot bracket.

Enclosed pivot mount plates 74A1 alternately could also be of the integral type having a foot or boot bracket or step in binding mount as an integral part. In such an embodiment the hole through which pivot mount plates 74A1 pass (and rotate in) in enclosures 118 and 120 could be modified from that which is shown in FIG. 11 to accept a pivot mount plate such as is shown in FIGS. 12 & 13. For alternate retention purposes in such an embodiment a retaining means such as a large snap ring for pivot mount plate 74A1 could be employed, probably at the underside of enclosures 118 and 120. The present embodiment could alternately have a guard enclosure/design that is split across the diameter of the hole that enclosures 118 and 120 operate in, and use the present profile of pivot mount plate 74A1, additionally having an integral foot or boot bracket. These alternate configurations are not fully illustrated in this patent application.

As can be seen in the sectional views of FIG. 11 pivot mount plates 74A1 rotate while "trapped between enclosures 118 and 120 and the sportingboard 68. Enclosures 118 and 120 act to retain and guide pivot mount plates 74A1 in the transmission of torque during operation. A fastener 56 is shown retaining drive belt 70 to pivot mount plate 74A1 in FIG. 11D. This can prevent slippage of drive belt 70 (or band, strap, chain, etc.) and simultaneously establish a stop for rotation. Pivot mount plate 74A1 has no thrust washer/shim between itself and sportingboard 68 shown in FIG. 11C. This is a viable option for this design as well as having an integral flange or washer formed in the surface of either pivot mount plate 74A1 or sporting board 68 acting to reduce or control friction during rotation. Likewise the same can be done at the interface between pivot mount plate 74A1 and enclosures 118 and 120. Further, the hole/opening in enclosures 118 and 120 can have a seal to prevent passage of contaminants, moisture, grease, etc.

Either or both of the enclosures 118 and 120 can be stressed structural elements of the sportingboard. In such a case the enclosures 118 and 120 essentially join with and become some of the "outer stressed fibers" of the unified structural assembly. Thus the upper portion of the sportingboard (enclosures 118 and 120), acting as an integral part of the unified assembly are subject to the compressive and tensile as well as torsional loads imposed on the sportingboard unit. This requires the enclosures 118 and 120 to be designed accordingly and also requires suitable joining methods with the sportingboard base. Since the mechanism is to be enclosed within the enclosures 118 and 120 this provides an opportunity for a higher cross sectional area which makes for a stronger design. However the surface interruptions (holes) for pivot mount plates 74A1 must be taken into account as well as a desire to maintain a low riding position for operator control. This embodiment of course will be a balance of these factors for optimal performance.

Typically embodiments having an integral type, enclosed mechanism, can be more finely tuned for optimal performance. This is possible since all components are designed simultaneously with consideration to each component as well as the rider. Embodiments that can fasten to existing sportingboards perform well and will probably be less costly for many operators since existing sportingboards may be retrofitted.

Description and Operation—FIGS. 12 & 13

FIG. 12 shows a foot binding mechanism that is a pivoting plate with a strap capable of holding a rider's foot directly. Retainer disc 72 holds in position and allows rotation of pivot mount plate-belt drive-with integral foot strap 74A2. A drive belt groove 124 can be seen in FIG. 12 which can receive belts chains, bands, etc. Padded foot strap 122 is able to receive a rider's foot with or without a water-shoe, water-sock, sneaker, etc. This embodiment is typically for use with surf type boards or mountain boards (or other sportingboards) that have a simpler foot retention device. Such simpler foot mounting devices typically have a single loop; either a continuous fixed loop or an adjustable band having two parts. Some extreme types of surfing have foot retention straps or loops for control as do mountainboards. Mountainboards have an essentially rigid board somewhat like a snowboard except that it is smaller and has front and rear wheels attached so that riders can operate on land such as a ski slope during summer months. Mountainboards are typically larger than a street type skateboard and typically have foot retention straps or loops. These embodiments of the present invention can be employed in any application that has an essentially rigid sportingboard that utilizes two foot mounting straps or two boot brackets for a rider.

It should be apparent that foot strap pivot mount plates 74A2 & 74A3—or a variation thereof—will work in the present invention with any of the drive embodiments shown, though all configurations are not illustrated. For example in the enclosed embodiment of FIG. 11, pivot mount plates 74A2& 74A3 may employ a snap ring (or other fastening means such as screws with clips) for retention. This is in lieu of retainer disc 72. In embodiments that use retainer disc 72 a cover plate (not shown in FIGS. 12 or 13) that covers disc 72 may be employed to shield the mechanism and/or provide foot comfort and/or protection for the rider. An alternative embodiment can have a "two-piece" foot strap pivot mount plate 74A2 similar to that shown in FIG. 6C yet with the integral padded foot strap 122 as shown in FIG. 12. In such an embodiment retainer disc 72 may not be needed or used. Other direct foot bindings that are used in wakeboarding similar to water ski bindings are possible as integral components of pivot mount plates 74 of the present invention. These types of bindings are also employable as bolt on components with the present invention.

The embodiment shown in FIG. 13 shows a boot type bracket as an integral component of the present invention. Pivot mount plate-belt drive-with integral boot bracket 74A3 is dynamic, or at least has the capability of being dynamic, throughout operation of the sportingboard. This embodiment is typically employed with snowboards, sandboards, or airboards, and also may or may not employ retainer disc 72 and may or may not have a cover plate (not illustrated) to cover/shield disc 72. Also boot bracket pivot mount plate 74A3 can be a two piece component as in FIG. 6*c* with additional integral features and parts as seen in FIG. 13.

Description and Operation—FIG. 14

FIG. 14 illustrates an embodiment of the present invention in a partial, broken, side view, showing a chain type drive system. A support flange-with bearing raceway 88A is shown in FIG. 14, which is fixed to sportingboard 68, and thus acts to retain pivot mount plate-chain driven 74E, via ball bearings 126. Pivot mount plate-chain driven 74E is also supported by lower bearing race 128 via bearings 126. Pivot mount plate-chain driven 74E is dynamic and has fastener holes (not shown in FIG. 14) in such a pattern to accept or mate with a foot or boot bracket. A chain (not shown in FIG. 14) engages sprocket teeth 130 to provide a rotary transmission means between the complimentary pivot mount plates 74E on a sportingboard so equipped. This embodiment can be used in "enclosed" or "open" designs of the present invention, but is better used in some form of an enclosed or "guarded" design, primarily for safety reasons. Pivot mount plate-chain driven 74E can have an integral foot or boot mount as an intrinsic portion or can be recessed into the surface of the sportingboard. The recessed embodiment works well particularly if the embodiment includes a structurally supporting guard or enclosure.

Description and Operation—FIG. 15

FIG. 15 shows an enclosed type drive system embodiment of the present invention shown in a partial, broken, side view. This embodiment is similar to the embodiment of FIG. 11 with two different features:

One different feature employs drive belt-cog toothed 70A, which has drive belt teeth 132, in a cog type pulley and belt system. Thus drive belt-cog toothed 70A engages pivot mount plate-belt drive-enclosed-with cog teeth 74A1A, which has cog wheel teeth 134, and provides a rotary transmission means that is inherently "non-slip".

Another different feature shown in FIG. 15 that is not shown in FIG. 11 is that sportingboard-with recession 68A is employed allowing for a lower physical position of pivot mount plate 74A1A. This allows for a more compact design and a lower center of gravity for the rider.

The operation of the embodiment shown in FIG. 15 is essentially the same as the embodiment of FIG. 11 except for the advantages of those features mentioned. Pivot mount plate-belt drive-enclosed-with cog teeth 74A1A can have integral foot or boot mounting means similar to FIGS. 12 & 13. Though not needed to prevent slippage of the rotary transmission elements, fasteners such as are shown in FIG. 11D can be employed as rotational limits, or stops. Other means such as clips which fixedly attach to either drive belt 70A and/or pivot mount plate 74A1A can be employed (not illustrated in these drawing FIGS.) as a rotational limiting means.

Description and Operation—FIG. 16

A sportingboard-with recession 68A is shown in FIG. 16, having fastener holes 50, a recessed surface 136, and pivot plate edge guides 138. This view shows the detail of a sportingboard typically used in embodiments such as FIG. 15 of the present invention or similar. Four discrete positions for a pivot mount plate 74 are outlined by the top recessed surface 136 and curved sections of the pivot plate edge guides 138. Thus for the one general pivot mount plate region shown in FIG. 16 of the sportingboard-with recession 68A, a rider's foot has the option of four different positions. Likewise the alternate foot region preferably also has four different positions available.

In operation pivot plate edge guides 138 provide support for pivot mount plates 74, to assist in maintaining their location during rotation relative to sportingboard 68A. It should be realized that this embodiment (or a variation thereof) is possible with any of the drive systems illustrated in this application.

Description and Operation—FIG. 17

Description—FIG. 17

The embodiment shown in FIG. 17 is similar to FIGS. 11 & 15 in that these embodiments are also enclosed and also employ a belt type drive system. The embodiment shown in FIG. 17 has an adjustable stop/limiting mechanism to limit the rotation of a rider's feet relative to the sportingboard. The elements/members of FIG. 17 are shown "exploded apart" in a partial oblique perspective with most parts shown partially in cross section. The embodiment of FIG. 17 employs major guard-enclosure-with pin and reinforcing boss 118A to function similarly to the embodiments of FIGS. 11 & 15 yet with additional features and functions. Major guard-enclosure 118A is attached to sportingboard 68A1 by fasteners (not shown) and is stationary relative to the sportingboard 68A1. Pivot mount plate-belt drive-enclosed-with indexing gear 74A1B is retained but allowed to pivot similar to FIGS. 11 and 15, although it is subject to the constraints of the adjustable stop/limiting mechanisms shown in this embodiment.

A release pin head 144 is shown attached to a release pin 140 that engages release pin dimple 150. It should be noted that a companion release pin head 144, and release pin 140 are part of major guard-enclosure 118A that has been "cut away" (and therefore not seen) from the foreground of the view of FIG. 17. The pins 140, and pin heads 144 are essentially symmetrical about fastener hole-reinforcing 50A. Release pin 140 is free to move up and down within a hole (not labeled) in major guard-enclosure 118A, which serves to also guide and retain pin 140. Pin 140 and pin head 144 act in unison and are spring loaded (springs not illustrated in FIG. 17) to return to an "up position", such as is shown in FIG. 17. Major guard-enclosure 118A also has reinforcing boss 142 as an integral part, which has fastener hole-reinforcing 50A formed at its interior.

Release pin dimple 150 is an integral part of locking lug 148, which has gear teeth 146 as an integral part also. Locking lug 148 is attached to spring tab extension 154, which is an integral part of base ring 156. Base ring 156 is positioned and guided by pivot plate boss extension 158, which is an integral part of pivot mount plate 74A1B. Pivot mount plate 74A1B has gear teeth 146, which are an integral feature, as is drive belt groove 124, and fastener holes 50.

Sportingboard-with recession-with tab relief groove 68A1, is shown in FIG. 17 as having recessed surface 136, two tab relief grooves 152, and multiple fastener holes 50 as integral features.

Operation—FIG. 17

Pivot plate boss extension 158 passes through both base rings 156, and continues through to be inserted into the recession in sportingboard 68A1 (to recessed surface 136). The gear teeth 146 in both of locking lugs 148 engage and mesh with the gear teeth 146 in pivot mount plate 74A1B. When in a normally operating position, spring tab extensions 154 are in plane with base ring 156 which causes the engagement of gear teeth 146 on both locking lugs 148 with those of pivot mount plate 74A1B. Thus in normal operation any rotation of pivot mount plate 74A1B causes a rotation of both lugs 148. However the rotation of lugs 148 is limited by reinforcing boss 142, which is strengthened by a long fastener which passes through fastener hole-reinforcing 50A. Fastener hole-reinforcing 50A is aligned with the fastener hole 50 which is located between tab relief grooves 152 on sportingboard 68A1. Reinforcing boss 142 thus acts as a stop for lugs 148.

For adjustment a rider rotates pivot mount plate 74A1B until lug 148 stops at reinforcing boss 142, which positions release pin dimple 150 under release pin 140. The rider then can press down on pin head 144 which disengages the meshed gear teeth of lug 148 with pivot mount plate 74A1B. The downward flexure of tab extension 154 is facilitated by tab relief groove 152, which accepts tab extension and lug 148. With pin head 144 depressed, the rider then rotates pivot mount plate 74A1B (via their respective foot) to the new desired terminal (end rotational) position. Upon achieving the desired (new) terminal position the rider then releases pin head 144 and thus pin 140 thereby allowing tab extension 154 and lug 148 to move upward (by spring tab extension 154's flexure force) and reengage pivot mount plate 74A1B via meshing gear teeth 146.

Two different rotational directions for the embodiment shown, one clockwise and one counterclockwise, thus require two of each:

tab relief grooves 152, spring tab extensions 154, base rings 156, locking lugs 148, release pins 140, and release pin heads 144.

Thus a limit is established for clockwise and counterclockwise rotations. To adjust the limit in the opposite rotational direction from a first rotational adjustment the rider rotates their foot in the opposite direction of the first rotational stop position and then uses the alternate release pin head 144, adjusting accordingly.

There is an ancillary benefit of having an adjustable stopping mechanism that has readily adjustable terminal (stopping) positions. That benefit allows the possible use of a pivoting foot mount plate to turn the forward foot more in line with the direction of travel. A rider can then detach the trailing foot from the sportingboard 68, and with the forward or leading foot still attached, "skate" along upon a relatively flat surface. This usage is advantageous in snowboarding applications when advancing to or departing from a ski lift. However with the introduction of the step-in binding systems many riders have become used to simply detaching the snowboard and walking while carrying it. However this is an option that is possible with the present invention, if so equipped with an adjustable stopping mechanism that will adjust to such a position.

Depending upon the mounting configuration of pivot mount plate 74A1B pin head 144 may or may not be directly accessible as shown in FIG. 17. If pin head 144 is shielded by a portion of a foot or boot mounting device (integral or attached) then a "key" or tool that allows a rider to actuate pin head 144 from a position otherwise inaccessible can be used. Such key can be in the form of a compact bladed pocket instrument carried by a rider similar to a flattened "stubby" screwdriver. This may be desirable to prevent inadvertent adjustment changes, as well as to shield pin head 144 from the elements—for example in a snowboarding application. Recessed surface 136 can be as shown in FIG. 16 with multiple locations for pivot mount plates 74A1B to be adjusted. This can be accomplished in different ways.

One way is to have relief grooves 152 located in a pattern that is rotated 90 degrees from the location shown in FIG. 17. Thus multiple relief grooves 152 (and companion fastener holes 50 for boss 142) do not interfere with recessed surfaces 136. This requires that pin 140, pin head 144, and related features of guard 118A, also be rotated 90 degrees to accommodate such an embodiment. This is not illustrated in the drawing FIGS. of this application.

The means for engaging and disengaging lug 148 needn't be as shown in FIG. 17. Lug 148 could otherwise be spring loaded to radially move on tab extension 154 and slide to engage/disengage pivot mount plate 74A1B. Relief grooves 152, pin head 144 & pin 140 would not be needed. A spring loaded and hinged lever which would hook dimple 150 (probably a deeper hole), and pull it outward to disengage and adjust stop positions would then most likely be used. This would probably be located in the sloped sidewall of guard 118A. An alternate version can have holes in pivot mount plate 74A1B and employ a pin (to engage these holes) attached to tab 154. Still many other embodiments that employ rotational stopping mechanisms are possible for the present invention.

Description and Operation—FIG. 18

The embodiment of FIG. 18 is shown in a partial, broken, side view, and is a sportingboard of the present invention having a more compact and integral design. This type of design is "laminated" or layered in a sense, where the drive components and pivot mount plates 74 are sandwiched in between the upper and lower portions of a sportingboard. Shown in FIG. 18 is a sportingboard group 68A2 having a sportingboard-with recession-laminated-lower portion 68A2A and a sportingboard-with recession-laminated-upper portion 68A2B with other parts attached.

A fastener 56 is shown holding sportingboard upper portion 68A2B to sportingboard lower portion 68A2A. Thus this embodiment provides access to the mechanical components contained within the core/center of the board via fasteners. Pivot mount plate-belt drive-enclosed-with cog teeth 74A1A operates similar to the embodiments of FIGS. 11 & 15, and can have an integral foot/boot bracket or a step-in type binding or any of the conventional "bolt on types" such as shown in prior art FIGS. 1 & 2. Since pivot mount plate 74A1A has cog wheel teeth 134, and meshes with drive belt teeth 132 of drive belt 70A, this embodiment is more like the embodiment of FIG. 15 than FIG. 11.

The advantages of having a more compact and enclosed design are a lowered center of gravity for the rider and a safer rotational transmission mechanism with less interference from the elements on the mechanism. This embodiment shows a removable upper portion of the sportingboard 68A2. Upper portion 68A2B can be manufactured in one continuous section which span includes both openings/holes for two pivot mount plates 74A1A, or two individual upper portions 68A2B can be employed. In a "single upper portion" embodiment different upper portions having different pivot mount plate hole center distances can provide for different rider (foot) stance positions.

In a "two upper portions" embodiment each pivot mount plate has an individual upper portion. The pivot mount plate holes for each of the upper portions can be offset rather than centered to provide for adjustment of foot centers. This essentially requires an otherwise symmetrical upper portion in every other respect. This feature allows flipping or rotating either or both upper portions to obtain a different stance distance of the rider's feet.

Still other adjustment options are available for upper portion 68A2B such as oval slots with oversized oval covers that have holes/openings for pivot mount plate 74A1A. It should be realized that it is not a necessity to have a removable upper portion such as upper portion 68A2B for this or other enclosed embodiments; a permanently sealed embodiment is possible.

The rotational transmission mechanism in such an embodiment can be installed within the core/center of the sportingboard as a "trapped" component, laminated permanently between upper and lower sections of the sportingboard, as an integral component. This has its attendant challenges regarding the durability of the drive mechanism, which should be made of high quality components since the drive mechanism is then essentially not serviceable at the inside portions. This design might be employed for custom sportingboard models that have a specific predetermined foot stance/distance, whereas the embodiments (FIG. 5 for example) which have the option to "bolt on" to standard sportingboards are more flexible regarding (foot) stance distance.

Description and Operation—FIG. 19

FIG. 19 shows an embodiment of the present invention that utilizes a shaft and gear drive mechanism for the rotational transmission means between pivot mount plates-bevel gear driven 74F. FIG. 19 is a top view of a sportingboard of the present invention showing the general placement of major components relative to each other. A gear shaft 160 is attached to two bevel gears 162. Bevel gears 162 engage pivot mount plates 74F. Both the bevel gears 162 and the pivot mount plates 74F have gear teeth to facilitate engagement, and thus, rotary transmission between gears 162 and plates 74F occurs. Not all elements are labeled or the details necessarily shown in FIG. 19 for a complete embodiment. For example bearings, bushings, guides, fastening elements, etc., as well as rotational stops (if used) or brake components (if used) are not shown in FIG. 19.

The embodiment of FIG. 19 can be either "enclosed" or "open" in design. Given the spatial constraints that are present with this type of drive system gear shaft 160 should probably be "embedded" or recessed in sportingboard 68. For adjustment of foot stance shaft 160 can be made in two parts with mating splined ends (i.e. 1 male & 1 female) to allow axial adjustment in overall length. This would allow the adjustment (by repositioning) of the separation distance of retainer discs 72, pivot mount plates 74F, and consequently whatever type of foot or boot brackets being used, weather integral, attached, or step-in/quick release. An alternative to this method of adjustment is to have either or both bevel gears 162 splined to shaft 160, which also would allow adjustment of a rider's foot stance.

This design requires that shaft 160 is flexible, since flexure of sportingboard 68 probably occurs during operation. Chain & belt type drive systems allow/accommodate flexure of sportingboard 68 better in enclosed type embodiments similar to FIG. 18, perhaps with friction reducing guides located between pivot mount plates 74 on/in sportingboard 68. Sheathed cable type designs such as shown in FIG. 5 readily accommodate flexure inherently, weather enclosed or open in design. Shaft 160 of FIG. 19 will have to be able to flex while rotating, as connecting rod 78 in FIG. 4 must flex while translating rotary motion between pivot mount plates 74.

Description and Operation—FIG. 20

FIG. 20 shows an embodiment that employs hydraulic cylinders in a closed circuit to provide rotational transmission between pivot mount plates-fluid piston driven 74G. FIG. 20 is a top view of a sportingboard of the present invention showing the general placement of major components relative to each other. Essentially a non-compressible fluid is used as a medium through which rotational movement of a first pivot mount plate 74G is used to impart motion to a second pivot mount plate 74G. This is accomplished with the cooperation of fluid line 164, which provides connection between fluid cylinders 166.

The mounting details of cylinders 166 are not shown in FIG. 20, but cylinders 166 should be mounted to sportingboard 68, and free to pivot at the mounting location. This facilitates the movement of pivot mount plates 74G via large pivot pins 76. Such a design is amenable to flexure of sportingboard 68. This embodiment is able to function in both enclosed and open designs. However this is probably best accomplished in an enclosed design or embodiment that shields cylinders 166. Cylinders can be embedded in sportingboard 68, and also shielded from the elements for example.

Description and Operation—FIG. 21

Shown in FIG. 21 is an embodiment of a ball type drive system that uses a closed circuit of lightweight and strong balls 170, that transmit motion through contact with each other and pivot plate ball stops 172. FIG. 21 is a top view of a sportingboard of the present invention showing the general placement of major components relative to each other. Pivot mount plates-ball driven 74H each has a ball stop 172, either as an integral component, or attached, which transmits rotational motion via balls 170. Ball tube 168, guides balls 170 in the closed circuit, essentially trapping them allowing motion in only the oval pathway defined. The ball tube 168 can be an integral component of sportingboard 68 as an enclosed groove for the balls to travel in.

Not all the balls 170 are shown in FIG. 21, only a portion of the (set of) balls are shown for clarity of illustration. The balls 170 transmit compressive force only therefore a completely filled circuit is necessary in this embodiment. This embodiment is very amenable to the flexure of sportingboard 68, especially if pathway/tube 168 is an integral part of sportingboard 68. The number of balls 170 in use can also be adjusted to accommodate changes in foot stance positions of pivot mount plates 74H.

A variation of this embodiment might include lightweight flexible "push rods" that would take the place of the balls that travel in the straight portions of tube 168. The balls 170 that would be removed would be those that never make it to the curved portions of the system around or very near pivot mount plates 74H. In this embodiment variation though the push rods would then have to be flexible to allow for rotational transmission of pivot mount plates 74H during flexure of the sportingboard 68.

Description and Operation—FIG. 22

Shown in FIG. 22 is an embodiment of the present invention that employs a rack gear 174 to provide rotational transmission between pivot mount plates-rack gear driven 74I. FIG. 22 is a top view of a sportingboard of the present invention showing the general placement of major components relative to each other. Rack gear guide 176 provides guidance for rack gear 174. Rack gear guide 176 probably best accommodates rack gear 174 if lined with P.T.F.E., or some other friction reduction material. This can be located just in the high stress areas adjacent to pivot mount plates 74I, possibly as part of a backlash adjustment component assisting in gear mesh. Rack gear 174 should be flexible to allow for flexure of sportingboard 68, yet must also be durable as a geared component.

Only one gear guide 176 & one gear 174 are shown in FIG. 22, however two guides 176 and two rack gears 174 can be used. This would enable smaller members to be used and/or provide greater durability of the design in general, as well as have advantages regarding symmetrical balance. Thus the sportingboard in FIG. 22 would, in such a modified version, then essentially be symmetrical about the longitudinal axis as well as the horizontal axis (as viewed in FIG. 22). This would more easily provide for symmetry of mass as well as provide for a more dynamically balanced design regarding forces and wear as well.

Gear guide 176 is probably best employed as an integral component of sportingboard 68. This would be a more compact "laminated type" of construction such as is shown in FIG. 18; albeit without using a belt type drive system. Thus sportingboard 68 would then fully contain and enclose gear guides 176, which would be either formed or cut out of the sportingboard upper and/or lower portions. Rack gear (or gears) 174 is then enclosed in such an embodiment. Such an enclosed embodiment provides a lower center of gravity, a drive mechanism that is better protected, and one that allows flexure of the sportingboard more readily since rack gear 174 is then closer to the neutral axis of the sportingboard.

Adjustable stops can readily be employed in many different ways for the embodiment of FIG. 22, though none are illustrated in FIG. 22. Stops can be basically classified, for the embodiment shown into three basic types:

1. Stops that interfere with the rotation of pivot mount plates 74I
2. Stops that interfere with the meshing of pivot mount plates 74I and gear 174
3. Stops that interfere with the translation of rack gear 174.

For an example of (1) above, the embodiment of FIG. 17 illustrates a variation of a similar embodiment able to lock pivot mount plates 74I. This variation of the embodiment of FIG. 17 requires the use of components not illustrated in FIG. 22. The embodiment of FIG. 22 lends itself to this design well since pivot mount plate 74I already has gear teeth to engage rack gear 174. Thus the gear teeth on pivot mount plate 74I would also engage a lug (or lugs) that also had teeth. This embodiment would have a greater sector available for adjustment (of rotational limits) if only one rack gear 174 is used, and the location of adjustment is opposite rack gear 174.

For an example of (2) above, an embodiment that has adjustable stops attached to either rack gear 174 or pivot mount plates 74I that causes interference at the engagement juncture of gear teeth is a viable design option. Thus the adjustable stop would essentially be a wedge shaped block (or blocks) that causes interference of gear teeth engagement. The wedge shaped block would be attached to, and ride with, gear 174 or pivot mount plates 74I. Adjustment (release and attachment of the block) would take place near the point of interference. The attachment means can use either a series of holes in either gear 174 or pivot mount plates 74I, with either a (releaseable) pin in the block, or mating gear teeth in the block, to lock the wedge shaped block to gear 174 or pivot mount plates 74I. A variety of other means can be used to temporarily lock a wedge shaped block to either member.

For an example of (3) above, an adjustable stop mechanism can be employed on rack gear 174 rather than on pivot mount plates 74I. For example a stop boss placed adjacent to the teeth of rack gear 174 essentially located between both pivot mount plates 74I can be employed. This would act similar to the boss in FIG. 17. Two "clips with spring-loaded locking lugs" (clips with lugs) would be slideably attached to rack gear 174. This embodiment would have one "clip with lug" on either side of the stop boss. The clips with lugs would slide over and "ride with" rack gear 174. The clips with lugs would have a spring that force lug teeth to engage and mesh with rack gear 174. Thus the clips with lugs mesh with, and maintain a locked position on rack gear 174, until released.

A means to release the lugs on the spring-loaded clips would be necessary to provide disengagement from a locked position on the rack gear. When the spring-forced clip with lug is disengaged at a point adjacent to the stop boss, and the rider rotates their foot/boot bracket to a new position, the rack gear slides through a clip with lug until the operator releases the lug. This would allow adjustment of one of the rotational stop positions. The opposite rotational stop position would be made after reversing direction of foot rotation then utilizing the alternate clip with lug and release means. The release means for the lugs with clips can be a button or lever the rider pushes, or a tool engaging the lugs with clips remotely.

FIG. 22 does not show details of any rotational stop mechanism, though many embodiments of FIG. 22 having a rotational stopping means are possible. A further example of this would be "interference blocks" that would fit in the ends of gear guides 176 snugly, probably held in place by friction. The material of manufacture would probably be polyurethane (or similar) to allow for a dampening effect as well as allow for a slight distortion that would allow the desired friction fit. A means of accessing the end portions of gear guides 176 is necessary for this embodiment, if changes are to be made after manufacture. Different sized interference blocks would provide for different rack gear 174 stop positions and thus different rotational limits.

The embodiment of FIG. 22 is very desirable in enclosed designs especially. This is due to the benefits of it being lightweight, simple in design, accommodating flexure of the sportingboard, can be made durable, and allows a compact profile and will allow adjustment of rider foot stance distance.

CONCLUSION, RAMIFICATIONS, AND SCOPE

Accordingly the reader is able to see that the present invention provides various embodiments all of which provide a new method of sport boarding. The ability to operate a sportingboard with foot attachment means such as a snowboard, wakeboard, airboard, sandboard, mountainboard, surfboard, or similar is enhanced by a greater freedom of movement with the present invention. Maneuvers that are otherwise not possible with sportingboards of the prior art are now possible by providing a means for a rider's feet to be pivoted cooperatively during operation. The ability for a rider to controllably reverse their initial foot positions and body posture relative to a sportingboard during operation enables a rider to reverse direction of travel and ride "backwards" from their initial orientation.

The ability to change direction can be sudden and rapid such as during airborne maneuvers where a rider can launch in one operational posture and land in the opposite posture. Sudden changes are also now possible with the present invention by a rider who, in a sequence 1. shifts their weight to the leading (forward) foot, and then
2. slightly (or significantly) lifts the trailing foot with sportingboard attached, and then
3. quickly pivots about the forward portion of the sportingboard, and simultaneously swings the trailing portion of the sportingboard around, thereby quickly reversing travel posture.

The rider's body thus turns slightly while maintaining essentially the original direction of travel relative to the earth; however the sportingboard is now completely reversed from the original direction of travel. This maneuver can be accomplished at various speeds of travel or while stationary.

Gradual sweeping turns can also be executed with a gradual, arcuate, chevron type pattern made on the traveling surface. For example a sweeping, gradual, left turn can be made until the sportingboard is facing approximately 90 degrees from the original direction of travel and the sportingboard slows or stops. The rider can then reverse their foot stance position (i.e. goofy to regular or vice versa) and continue their travel again. The rider then begins another left hand turn (now a left hand turn from the new foot stance position) coming back out of the 90 degree turn and reentering the original line of travel. Thus a chevron pattern is made, the point of which is oriented essentially 90 degrees from a general line or direction of travel. Turning of the sportingboard can be executed at various speeds of travel. Foot stance pivoting can also be executed slowly throughout the arcuate turns or suddenly at the reversing point of the maneuver (chevron point).

Many other maneuvers are also possible with the present invention since this enhanced freedom of movement allows riding (shooting) in both regular and goofy positions, and other positions in between. Thus not only the terminal or (rotational) end limit positions are used, but an infinite number of positions between the extreme limits as well. New and different maneuvers other than those mentioned are possible since "real time" dynamic adjustment of a rider's position is made relative to the sportingboard, while the sportingboard itself is dynamic relative to the surface over which it travels.

Further enhanced features such as fixed or adjustable rotational stops, and friction control devices are identified as embodiments of the present invention that can be employed for further control.

While the present invention has been described with reference to selected preferred embodiments, it should not be limited to those embodiments. Many variations in the means of mounting a rider's feet, the means of rotational transmission, and the means of controlling and/or limiting rotational transmission are possible within the scope of the present invention. For example a matched hook and loop fastener (or similar) system can be employed as a means of retaining a rider's feet or shoes to pivot mount plates 74, perhaps for a "street type" sportingboard, similar to a mountainboard. Thus, many modifications and variations will become apparent to those skilled in the art without departure from the scope and spirit of this invention as defined in the appended claims.

I claim:

1. A method of riding a sportingboard such as a snowboard, wakeboard, mountainboard, or surfboard for a rider having naked feet or feet shod with footwear comprising:

a) providing a rider operated sportingboard such as a snowboard, wakeboard, mountainboard, or surfboard, b) providing two pivot mount plates that are rotatably attached to a principal mounting surface of said sportingboard and being freely rotatably with respect to said principal mounting surface, said two pivot mount plates including securing means for attaching said naked feet or said feet shod with footwear of said rider to attach to said pivot mount plates, c) providing a rotary driving means interconnecting said two pivot mount plates for coordinating simultaneous rotational transmission between said two pivot mount plates, and d) enabling said rider to simultaneously rotate said naked feet or feet shod with footwear that are attached to said two pivot mount plates while maintaining the same rotational direction of alignment with respect to said principal mounting surface while riding said sportingboard such as a snowboard, wakeboard, mountainboard, or surfboard upon a surface or in a fluid.

2. The method of claim 1 wherein the provision for said rotary driving means between said two pivot mount plates includes providing a device selected from the group consisting of belt drives and band drives and chain drives and rack gear drives and geared shaft drives and cable drives and fluid piston drives and connecting rod drives and ball drives.

3. The method of claim 2 wherein the provision for rotary driving means further includes braking means providing rotational friction control of said rotary driving means, whereby rotational movement of said two pivot mount plates can be resisted or stopped by said rider for further control while riding said sportingboard.

4. The method of claim 2 wherein the provision for rotary driving means further includes locking means providing a locking mechanism that prevents rotational movement of said rotary driving means, whereby rotational movement of said two pivot mount plates can be completely stopped, thus enabling a rider to temporarily maintain a selected fixed foot position relative to said sportingboard during riding.

5. The method of claim 2 wherein the provision for rotary driving means further includes rotational stopping means providing rotational stop positions for said rotary driving means, whereby rotational movement can be limited, thus enabling a rider to repeatedly and cooperatively rotate said two pivot mount plates between predetermined rider selected foot positions such as goofy and regular or other preferred foot positions while riding said sportingboard.

6. The method of claim 5 wherein the provision for said rotational stopping means further includes adjustment means providing adjustable stop positions for said rotational stopping means, whereby a rider can readily adjust the limits of rotational movement of said two pivot mount plates and thus establish temporary goofy and regular or other preferred foot positions that can be readily changed by a rider.

7. The method of claim 6 wherein the provision for said rotary driving means further includes shielding means providing guarding and/or enclosing functions for said rotary driving means whereby protection for said rotary driving means is obtained and/or safety is provided for said rider or bystanders while riding said sportingboard.

8. The method of claim 7 wherein the provision for said shielding means providing guarding and/or enclosing functions for said rotary driving means is embodied as an integral component or components of said sportingboard whereby protection for said rotary driving means and/or safety provided for said rider is embodied more compactly thus enabling said rider to have a lower center of gravity and greater control while riding said sportingboard.

9. The method of claim 8 wherein the provision for rotary driving means further includes braking means providing rotational friction control of said rotary driving means, whereby rotational movement of said two pivot mount plates can be resisted or stopped by said rider for further control while riding said sportingboard.

10. An adjustable foot binding mechanism for use with a sportingboard such as a snowboard, wakeboard, mountainboard, or surfboard comprising:

a) a first rotatable pivot mount plate including receiving means to mount a first foot of a rider or first foot including a boot or shoe; and b) a second rotatable pivot mount plate including receiving means to mount a second foot of the rider or second foot including a boot or shoe; and c) securing means for rotatably attaching said first rotatable pivot mount plate and said second rotatable pivot mount plate to a principal mounting surface of said sportingboard such as a snowboard, wakeboard, mountainboard, or surfboard; and d) a rotational coupling means interconnecting said first and second rotatable pivot mount plates for accomplishing rotational transmission between said first rotatable pivot mount plate and said second rotatable pivot mount plate so as to enable simultaneous rotation of said first and second rotatable pivot mount plates essentially in unison while maintaining the same rotational direction of alignment with respect to said principal mounting surface.

11. An adjustable foot binding mechanism as recited in claim 10 wherein said rotational coupling means for accomplishing rotational transmission between said first rotatable pivot mount plate and said second rotatable pivot mount plate employs a device selected from the group consisting of belt drives and band drives and chain drives and rack gear drives and geared shaft drives and cable drives and fluid piston drives and connecting rod drives and ball drives.

12. An adjustable foot binding mechanism as recited in claim 10 further comprising anti-rotation means associated with said rotational transmission means, for locking said first rotatable pivot mount plate and said second rotatable pivot mount plate from rotation relative essentially to said sportingboard, whereby rotational movement can be stopped, thus enabling a rider to temporarily maintain a selected foot position relative to a sportingboard that is equipped with the sportingboard binding system of the present invention.

13. An adjustable foot binding mechanism as recited in claim 10 further comprising braking means, associated with said rotational transmission means, for adjusting the amount of rotational resistance of said first rotatable pivot mount plate and said second rotatable pivot mount plate relative essentially to said sportingboard, whereby rotational movement can be resisted or stopped by said rider for further control of a sportingboard equipped with the sportingboard binding system of the present invention.

14. An adjustable foot binding mechanism as recited in claim 11 further comprising limiting means associated with said rotational transmission means, for establishing rotational stopping positions that limit rotation of said first rotatable pivot mount plate and said second rotatable pivot mount plate relative essentially to said sportingboard, whereby rotational movement can be limited, thus enabling a rider to repeatedly obtain the same goofy or regular or other preferred foot positions with the sportingboard binding system of the present invention.

15. An adjustable foot binding mechanism as recited in claim 14 wherein said limiting means associated with said rotational transmission means, further includes adjusting means associated with said limiting means for establishing temporary stopping positions for said first rotatable pivot mount plate and for said second rotatable pivot mount plate that limit rotation relative essentially to said sportingboard, whereby limits of rotational movement can be readily changed for goofy or regular or other preferred foot stance positions with the sportingboard binding system of the present invention.

16. An adjustable foot binding mechanism as recited in claim 15 further comprising shielding means associated with said rotational transmission means for guarding and/or enclosing said rotational transmission means and/or said limiting means and/or said adjusting means from adverse effects of an operating environment and/or to provide protection for a rider or for bystanders from entanglement, whereby a more durable and safer sportingboard binding system of the present invention can be employed.

17. An adjustable foot binding mechanism as recited in claim 16 wherein said shielding means associated with said rotational transmission means is an integral component of said sportingboard, whereby a more compact sportingboard binding system of the present invention allowing a lower center of gravity and greater control of said sportingboard can be operated.

18. An adjustable foot binding mechanism as recited in claim 17 further comprising braking means, associated with said rotational transmission means, for adjusting the amount of rotational resistance of said first rotatable pivot mount plate and said second rotatable pivot mount plate relative essentially to said sportingboard, whereby rotational movement can be resisted or stopped by said rider for further control of a sportingboard equipped with the sportingboard binding system of the present invention.

* * * * *